US008770297B2

(12) United States Patent
Bailey et al.

(10) Patent No.: US 8,770,297 B2
(45) Date of Patent: Jul. 8, 2014

(54) SUBSEA INTERNAL RISER ROTATING CONTROL HEAD SEAL ASSEMBLY

(75) Inventors: Thomas F. Bailey, Houston, TX (US); Danny W. Wagoner, Cypress, TX (US); Waybourn J. Anderson, Jr., Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 13/597,881

(22) Filed: Aug. 29, 2012

(65) Prior Publication Data

US 2012/0318496 A1 Dec. 20, 2012

Related U.S. Application Data

(62) Division of application No. 12/643,093, filed on Dec. 21, 2009, now Pat. No. 8,322,432.

(60) Provisional application No. 61/205,209, filed on Jan. 15, 2009.

(51) Int. Cl.
*E21B 23/00* (2006.01)
*E21B 33/035* (2006.01)

(52) U.S. Cl.
USPC ..... 166/344; 166/338; 166/358; 166/84.3; 166/85.1

(58) Field of Classification Search
USPC ..... 166/344, 338, 339, 341, 351, 352, 358, 166/367, 86.1, 86.2, 84.3, 85.1, 85.3; 175/325.1, 325.3; 277/323, 328, 337
See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 2,038,140 | A | 7/1931 | Stone |

(Continued)

FOREIGN PATENT DOCUMENTS

| | | |
|---|---|---|
| AU | 199927822 B2 | 9/1999 |
| AU | 200028183 A1 | 9/2000 |

(Continued)

OTHER PUBLICATIONS

US 6,708,780, 03/2004, Bourgoyne et al. (withdrawn).

(Continued)

*Primary Examiner* — Matthew Buck
(74) *Attorney, Agent, or Firm* — Strasburger & Price, LLP

(57) ABSTRACT

An RCD is used to provide a system and method for sealing a marine riser having a rotatable tubular. A bypass internal channel or external line may be used to allow fluid to bypass the RCD seal. An RCD holding member seal could be a mechanically extrudable seal or a hydraulically expanded seal to seal the RCD with the riser.

27 Claims, 22 Drawing Sheets

(56) References Cited

U.S. PATENT DOCUMENTS 1,831,956 A 11/1931 Harrington
1,836,470 A 12/1931 Humason et al.
1,902,906 A 3/1933 Seamark
1,942,366 A 1/1934 Seamark
2,036,537 A 4/1936 Otis
2,071,197 A 2/1937 Burns et al.
2,124,015 A 7/1938 Stone et al.
2,126,007 A 8/1938 Gulberson et al.
2,144,682 A 1/1939 MacClatchie
2,148,844 A 2/1939 Stone et al.
2,163,813 A 6/1939 Stone et al.
2,165,410 A 7/1939 Penick et al.
2,170,915 A 8/1939 Schweitzer
2,170,916 A 8/1939 Schweitzer et al.
2,175,648 A 10/1939 Roach
2,176,355 A 10/1939 Otis
2,185,822 A 1/1940 Young
2,199,735 A 5/1940 Beckman
2,211,122 A 8/1940 Howard
2,222,082 A 11/1940 Leman et al.
2,233,041 A 2/1941 Alley
2,243,340 A 5/1941 Hild
2,243,439 A 5/1941 Pranger et al.
2,287,205 A 6/1942 Stone
2,303,090 A 11/1942 Pranger et al.
2,313,169 A 3/1943 Penick et al.
2,325,556 A 7/1943 Taylor, Jr. et al.
2,338,093 A 1/1944 Caldwell
2,480,955 A 9/1949 Penick
2,506,538 A 5/1950 Bennett
2,529,744 A 11/1950 Schweitzer, Jr.
2,609,836 A 9/1952 Knox
2,628,852 A 2/1953 Voytech
2,646,999 A 7/1953 Barske
2,649,318 A 8/1953 Skillman
2,731,281 A 1/1956 Knox
2,746,781 A 5/1956 Jones
2,760,750 A 8/1956 Schweitzer, Jr. et al.
2,760,795 A 8/1956 Vertson
2,764,999 A 10/1956 Stanbury
2,808,229 A 10/1957 Bauer et al.
2,808,230 A 10/1957 McNeil et al.
2,846,178 A 8/1958 Minor
2,846,247 A 8/1958 Davis
2,853,274 A 9/1958 Collins
2,862,735 A 12/1958 Knox
2,886,350 A 5/1959 Horne
2,904,357 A 9/1959 Knox
2,927,774 A 3/1960 Ormsby
2,929,610 A 3/1960 Stratton
2,962,096 A 11/1960 Knox
2,995,196 A 8/1961 Gibson et al.
3,023,012 A 2/1962 Wilde
3,029,083 A 4/1962 Wilde
3,032,125 A 5/1962 Hiser et al.
3,033,011 A 5/1962 Garrett
3,052,300 A 9/1962 Hampton
3,096,999 A 7/1963 Ahlstone et al.
3,100,015 A 8/1963 Regan
3,128,614 A 4/1964 Auer
3,134,613 A 5/1964 Regan
3,142,338 A * 7/1964 Brown ..... 166/120
3,176,996 A 4/1965 Barnett
3,203,358 A 8/1965 Regan et al.
3,209,829 A 10/1965 Haeber
3,216,731 A 11/1965 Dollison
3,225,831 A 12/1965 Knox
3,259,198 A 7/1966 Montgomery et al.
3,268,233 A 8/1966 Brown
3,282,342 A * 11/1966 Mott ..... 166/120
3,285,352 A 11/1966 Hunter
3,288,472 A 11/1966 Watkins
3,289,761 A 12/1966 Smith et al.
3,294,112 A 12/1966 Watkins
3,302,048 A 1/1967 Gray
3,313,345 A 4/1967 Fischer
3,313,358 A 4/1967 Postlewaite et al.
3,323,773 A 6/1967 Walker
3,333,870 A 8/1967 Watkins
3,347,567 A 10/1967 Watkins
3,360,048 A 12/1967 Watkins
3,372,761 A 3/1968 van Gils
3,387,851 A 6/1968 Cugini
3,397,928 A 8/1968 Galle
3,400,938 A 9/1968 Williams
3,401,600 A 9/1968 Wood
3,405,763 A 10/1968 Pitts et al.
3,421,580 A 1/1969 Fowler et al.
3,424,197 A 1/1969 Yanagisawa
3,443,643 A 5/1969 Jones
3,445,126 A 5/1969 Watkins
3,452,815 A 7/1969 Watkins
3,472,518 A 10/1969 Harlan
3,476,195 A 11/1969 Galle
3,481,610 A 12/1969 Slator et al.
3,485,051 A 12/1969 Watkins
3,492,007 A 1/1970 Jones
3,493,043 A 2/1970 Watkins
3,503,460 A 3/1970 Gadbois
3,522,709 A 8/1970 Vilain
3,529,835 A 9/1970 Lewis
3,561,723 A 2/1971 Cugini
3,583,480 A 6/1971 Regan
3,587,734 A 6/1971 Shaffer
3,603,409 A 9/1971 Watkins
3,621,912 A * 11/1971 Wooddy et al. ..... 166/340
3,631,834 A 1/1972 Gardner et al.
3,638,721 A 2/1972 Harrison
3,638,742 A 2/1972 Wallace
3,653,350 A 4/1972 Koons et al.
3,661,409 A 5/1972 Brown et al.
3,664,376 A 5/1972 Watkins
3,667,721 A 6/1972 Vujasinovic
3,677,353 A 7/1972 Baker
3,724,862 A 4/1973 Biffle
3,741,296 A 6/1973 Murman et al.
3,779,313 A 12/1973 Regan
3,815,673 A 6/1974 Bruce et al.
3,827,511 A 8/1974 Jones
3,847,215 A 11/1974 Herd
3,868,832 A 3/1975 Biffle
3,872,717 A 3/1975 Fox
3,924,678 A 12/1975 Ahlstone
3,926,457 A * 12/1975 Williams et al. ..... 285/39
3,934,887 A 1/1976 Biffle
3,952,526 A 4/1976 Watkins et al.
3,955,622 A 5/1976 Jones
3,965,987 A 6/1976 Biffle
3,976,148 A 8/1976 Maus et al.
3,984,990 A 10/1976 Jones
3,992,889 A 11/1976 Watkins et al.
3,999,766 A 12/1976 Barton
4,037,890 A 7/1977 Kurita et al.
4,046,191 A 9/1977 Neath
4,052,703 A 10/1977 Collins, Sr. et al.
4,053,023 A 10/1977 Herd et al.
4,063,602 A 12/1977 Howell et al.
4,087,097 A 5/1978 Bossens et al.
4,091,881 A 5/1978 Maus
4,098,341 A 7/1978 Lewis
4,099,583 A 7/1978 Maus
4,109,712 A 8/1978 Regan
4,143,880 A 3/1979 Bunting et al.
4,143,881 A 3/1979 Bunting
4,149,603 A 4/1979 Arnold
4,154,448 A 5/1979 Biffle
4,157,186 A 6/1979 Murray et al.
4,183,562 A 1/1980 Watkins et al.
4,200,312 A 4/1980 Watkins
4,208,056 A 6/1980 Biffle
4,216,835 A 8/1980 Nelson
4,222,590 A 9/1980 Regan
4,249,600 A 2/1981 Bailey
4,281,724 A 8/1981 Garrett

(56) References Cited

U.S. PATENT DOCUMENTS 4,282,939 A 8/1981 Maus et al.
4,285,406 A 8/1981 Garrett et al.
4,291,772 A 9/1981 Beynet
4,293,047 A 10/1981 Young
4,304,310 A 12/1981 Garrett
4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,440,239 A 4/1984 Evans
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,488,703 A 12/1984 Jones
4,497,592 A 2/1985 Lawson
4,500,094 A 2/1985 Biffle
4,502,534 A 3/1985 Roche et al.
4,508,313 A 4/1985 Jones
4,509,405 A 4/1985 Bates
4,519,577 A 5/1985 Jones
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,575,426 A 3/1986 Bailey
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey
4,688,633 A 8/1987 Barkley
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,751,965 A * 6/1988 Cassity ..... 166/182
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,844,406 A 7/1989 Wilson
4,865,137 A 9/1989 Bailey
4,882,830 A 11/1989 Carstensen
4,909,327 A 3/1990 Roche
4,921,259 A * 5/1990 Saunders ..... 277/328
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey
5,040,600 A 8/1991 Bailey et al.
5,048,621 A 9/1991 Bailey
5,062,450 A 11/1991 Bailey
5,062,479 A 11/1991 Bailey et al.
5,072,795 A 12/1991 Delgado et al.
5,076,364 A 12/1991 Hale et al.
5,082,020 A 1/1992 Bailey
5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,174,376 A * 12/1992 Singeetham ..... 166/208
5,178,215 A 1/1993 Yenulis et al.
5,182,979 A 2/1993 Morgan
5,184,686 A 2/1993 Gonzalez
5,195,754 A 3/1993 Dietle
5,205,165 A 4/1993 Jardine et al.
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.

(56) References Cited

U.S. PATENT DOCUMENTS 5,305,839 A 4/1994 Kalsi et al.
5,307,879 A * 5/1994 Kent ..... 166/382
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey
5,431,220 A 7/1995 Bailey
5,443,129 A 8/1995 Bailey et al.
5,495,872 A 3/1996 Gallagher et al.
5,529,093 A 6/1996 Gallagher et al.
5,588,491 A 12/1996 Tasson et al.
5,607,019 A 3/1997 Kent
5,647,444 A 7/1997 Williams
5,657,820 A 8/1997 Bailey et al.
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
5,952,569 A 9/1999 Jervis
5,960,881 A 10/1999 Allamon et al.
6,007,105 A 12/1999 Dietle et al.
6,016,880 A 1/2000 Hall et al.
6,017,168 A 1/2000 Fraser, Jr.
6,036,192 A 3/2000 Dietle et al.
6,039,118 A 3/2000 Carter et al.
6,050,348 A 4/2000 Richarson et al.
6,070,670 A 6/2000 Carter et al.
6,076,606 A 6/2000 Bailey
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey
6,120,036 A 9/2000 Kalsi et al.
6,129,152 A 10/2000 Hosie et al.
6,138,774 A 10/2000 Bourgoyne, Jr. et al.
6,170,576 B1 1/2001 Bailey
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 * 5/2001 Peterman et al. ..... 175/214
6,244,359 B1 6/2001 Bridges et al.
6,263,982 B1 7/2001 Hannegan et al.
6,273,193 B1 8/2001 Hermann
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,352,129 B1 3/2002 Best
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 * 10/2002 Bourgoyne et al. ..... 175/57
6,478,303 B1 11/2002 Radcliffe
6,494,462 B2 12/2002 Dietle
6,504,982 B1 1/2003 Greer, IV
6,505,691 B2 1/2003 Judge
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,904,981 B2 6/2005 Jan van Riet
6,913,092 B2 7/2005 Bourgoyne
6,945,330 B2 9/2005 Wilson et al.
7,004,444 B2 2/2006 Kinder
7,007,913 B2 3/2006 Kinder
7,011,167 B2 3/2006 Ebner
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 * 7/2006 Bailey et al. ..... 166/84.4
7,086,481 B2 8/2006 Hosie et al.
7,152,680 B2 12/2006 Wilson et al.
7,159,669 B2 * 1/2007 Bourgoyne et al. ..... 166/382
7,165,610 B2 * 1/2007 Hopper ..... 166/84.4
7,174,956 B2 2/2007 Williams et al.
7,178,600 B2 2/2007 Luke et al.
7,191,840 B2 3/2007 Bailey
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 * 8/2007 Bourgoyne et al. ..... 166/382
7,270,185 B2 * 9/2007 Fontana et al. ..... 166/358
7,278,494 B2 10/2007 Williams
7,278,496 B2 10/2007 Leuchtenberg
7,296,628 B2 11/2007 Robichaux
7,308,954 B2 12/2007 Martin-Marshall
7,325,610 B2 2/2008 Giroux et al.
7,334,633 B2 2/2008 Williams et al.
7,347,261 B2 3/2008 Markel et al.
7,350,590 B2 4/2008 Hosie et al.
7,363,860 B2 4/2008 Wilson et al.
7,367,411 B2 5/2008 Leuchtenberg
7,377,334 B2 5/2008 May
7,380,590 B2 6/2008 Hughes
7,380,591 B2 6/2008 Williams
7,380,610 B2 6/2008 Williams
7,383,876 B2 6/2008 Gray et al.
7,389,183 B2 6/2008 Gray
7,392,860 B2 7/2008 Johnston
7,413,018 B2 8/2008 Hosie et al.
7,416,021 B2 8/2008 Williams
7,416,226 B2 8/2008 Williams
7,448,454 B2 11/2008 Bourgoyne et al.
7,451,809 B2 11/2008 Noske et al.
7,475,732 B2 1/2009 Hosie et al.

(56) References Cited

U.S. PATENT DOCUMENTS

| | | | | |
|---|---|---|---|---|
| 7,487,837 | B2 * | 2/2009 | Bailey et al. | 166/345 |
| 7,513,300 | B2 | 4/2009 | Pietras et al. | |
| 7,559,359 | B2 | 7/2009 | Williams | |
| 7,559,366 | B2 * | 7/2009 | Hunter et al. | 166/217 |
| 7,635,034 | B2 | 12/2009 | Williams | |
| 7,650,950 | B2 | 1/2010 | Leuchtenberg | |
| 7,654,325 | B2 | 2/2010 | Giroux et al. | |
| 7,669,649 | B2 | 3/2010 | Williams | |
| 7,699,109 | B2 * | 4/2010 | May et al. | 166/367 |
| 7,699,110 | B2 * | 4/2010 | Anderson et al. | 166/368 |
| 7,708,089 | B2 | 5/2010 | Williams | |
| 7,712,523 | B2 | 5/2010 | Snider et al. | |
| 7,717,169 | B2 | 5/2010 | Williams | |
| 7,717,170 | B2 | 5/2010 | Williams | |
| 7,726,416 | B2 | 6/2010 | Williams | |
| 7,735,562 | B2 * | 6/2010 | Bennett et al. | 166/345 |
| 7,743,823 | B2 | 6/2010 | Hughes et al. | |
| 7,762,320 | B2 | 7/2010 | Williams | |
| 7,766,100 | B2 | 8/2010 | Williams | |
| 7,779,903 | B2 | 8/2010 | Bailey et al. | |
| 7,789,132 | B2 | 9/2010 | Williams | |
| 7,789,172 | B2 | 9/2010 | Williams | |
| 7,793,719 | B2 | 9/2010 | Snider et al. | |
| 7,798,250 | B2 | 9/2010 | Williams | |
| 7,802,635 | B2 | 9/2010 | Leduc et al. | |
| 7,819,204 | B2 * | 10/2010 | Bamford | 175/5 |
| 7,823,665 | B2 | 11/2010 | Sullivan | |
| 7,836,946 | B2 | 11/2010 | Bailey et al. | |
| 7,836,973 | B2 | 11/2010 | Belcher et al. | |
| 7,926,593 | B2 | 4/2011 | Bailey et al. | |
| 7,997,345 | B2 | 8/2011 | Hannegan | |
| 8,033,335 | B2 * | 10/2011 | Orbell et al. | 166/367 |
| 8,286,734 | B2 | 10/2012 | Hannegan et al. | |
| 8,322,432 | B2 | 12/2012 | Bailey et al. | |
| 8,347,966 | B2 * | 1/2013 | Nguyen et al. | 166/345 |
| 2003/0106712 | A1 * | 6/2003 | Bourgoyne et al. | 175/5 |
| 2003/0164276 | A1 | 9/2003 | Snider et al. | |
| 2004/0017190 | A1 | 1/2004 | McDearmon et al. | |
| 2005/0000698 | A1 * | 1/2005 | Bailey et al. | 166/387 |
| 2005/0151107 | A1 | 7/2005 | Shu | |
| 2005/0161228 | A1 | 7/2005 | Cook et al. | |
| 2006/0037782 | A1 | 2/2006 | Martin-Marshall | |
| 2006/0108119 | A1 * | 5/2006 | Bailey et al. | 166/341 |
| 2006/0144622 | A1 * | 7/2006 | Bailey et al. | 175/230 |
| 2006/0157282 | A1 | 7/2006 | Tilton et al. | |
| 2006/0191716 | A1 | 8/2006 | Humphreys | |
| 2007/0051512 | A1 | 3/2007 | Markel et al. | |
| 2007/0095540 | A1 | 5/2007 | Kozicz | |
| 2007/0163784 | A1 | 7/2007 | Bailey | |
| 2008/0169107 | A1 | 7/2008 | Redlinger et al. | |
| 2008/0210471 | A1 | 9/2008 | Bailey et al. | |
| 2008/0236819 | A1 | 10/2008 | Foster et al. | |
| 2008/0245531 | A1 | 10/2008 | Noske et al. | |
| 2009/0025930 | A1 | 1/2009 | Iblings et al. | |
| 2009/0101351 | A1 | 4/2009 | Hannegan et al. | |
| 2009/0101411 | A1 | 4/2009 | Hannegan et al. | |
| 2009/0139724 | A1 | 6/2009 | Gray et al. | |
| 2009/0152006 | A1 | 6/2009 | Leduc et al. | |
| 2009/0166046 | A1 | 7/2009 | Edvardson et al. | |
| 2009/0200747 | A1 | 8/2009 | Williams | |
| 2009/0211239 | A1 | 8/2009 | Askeland | |
| 2009/0236144 | A1 | 9/2009 | Todd et al. | |
| 2009/0301723 | A1 | 12/2009 | Gray | |
| 2010/0008190 | A1 | 1/2010 | Gray et al. | |
| 2010/0025047 | A1 | 2/2010 | Sokol | |
| 2010/0175882 | A1 | 7/2010 | Bailey et al. | |
| 2011/0024195 | A1 | 2/2011 | Hoyer | |
| 2011/0036629 | A1 | 2/2011 | Bailey et al. | |
| 2011/0036638 | A1 | 2/2011 | Sokol | |
| 2012/0318496 | A1 | 12/2012 | Bailey et al. | |

FOREIGN PATENT DOCUMENTS

| | | | |
|---|---|---|---|
| AU | 200028183 | B2 | 9/2000 |
| CA | 2363132 | A1 | 9/2000 |
| CA | 2447196 | A1 | 4/2004 |
| CA | 2690289 | | 7/2010 |
| EP | 0290250 | A2 | 11/1988 |
| EP | 0290250 | A3 | 11/1988 |
| EP | 267140 | B1 | 3/1993 |
| EP | 1375817 | A1 | 1/2004 |
| EP | 1519003 | A1 | 3/2005 |
| EP | 1659260 | A2 | 5/2006 |
| GB | 1161299 | | 8/1969 |
| GB | 2019921 | A | 11/1979 |
| GB | 2067235 | A | 7/1981 |
| GB | 2362668 | A | 11/2001 |
| GB | 2394738 | A | 5/2004 |
| GB | 2394741 | A | 5/2004 |
| GB | 2449010 | A | 8/2007 |
| WO | WO 93/06335 | | 4/1993 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 01/79654 | A1 | 10/2001 |
| WO | WO 02/36928 | A1 | 5/2002 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |
| WO | WO 2009/123476 | A1 | 10/2009 |

OTHER PUBLICATIONS

U.S. Appl. No. 60/079,641, Abandoned, but Priority Claimed in above US Patent Nos. 6,203,824B1 and 6,102,673 and PCT WO 99/50524, filed Mar. 27, 1998.

U.S. Appl. No. 60/122,530, Abandoned, but Priority Claimed in US Patent No. 6,470,975B1, filed Mar. 2, 1999.

U.S. Appl. No. 61/205,209, Abandoned, but priority claimed in US2010/0175882A1, filed Jan. 15, 2009.

The Modular T BOP Stack System, Cameron Iron Works © 1985 (5 pages).

Cameron HC Collet Connector, © 1996 Cooper Cameron Corporation, Cameron Division (12 pages).

Riserless drilling: circumventing the size/cost cycle in deepwater—Conoco, Hydril project seek enabling technologies to drill in deepest water depths economically, May 1986 Offshore Drilling Technology (p. 49, 50, 52, 53, 54 and 55).

Williams Tool Company—Home Page—Under Construction Williams Rotating Controls Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams higher pressure rotating control head systems and Ideally suited for new technology flow and closed loop underbalanced drilling (UBD) Vertical and Horizontal (2 pages); and How to Contact Us (2 pages).

Offshore—World Trends and Technology for Offshore Oil and Gas Operations, Mar. 1998; Seismic: Article entitled, "Shallow Flow Diverter JIP Spurred by Deepwater Washouts" (3 pages including cover page, table of contents and p. 90).

Williams Tool Co., Inc. Rotating Controls Heads and Strippers for Air, Gas, Mud, and Geothermal Drilling Worldwide—Sales Rental Service, © 1988 (19 pages).

Williams Tool Co., Inc. 19 page brochure © 1991 Williams Tool Co., Inc. (19 pages).

FIG. 19 Floating Piston Drilling Choke Design: May of 1997.

(56) References Cited

OTHER PUBLICATIONS

Blowout Preventer Testing for Underbalanced Drilling by Charles R. "Rick" Stone and Larry A. Cress. Signa Engineering Corp., Houston, Texas (24 pages) Sep. 1997.
Williams Tool Co., Inc. Instructions, Assemble & Disassemble Model 9000 Bearing Assembly (cover page and 27 numbered pages).
Williams Tool Co., Inc. Rotating Controls Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Enviormental Impact, 4 pages, ( © 1995).
Williams Rotating Control Heads, Reduce Costs Increase Safety Reduce Enviornmental Impact (4 pages).
Williams Tool Co., Inc. Sales-Rental-Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An article—The Brief Jan. 1996, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (6 pages).
1966-1967 Composite Catalog—Grant Rotating Drilling Head for Air, Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Darryl A. Bourgoyne, Adam T. Bourgoyne, and Don Hannegan—1998 (International Association of Drilling Contractors International Deep Water Well Control Conference held in Houston, Texas, Aug. 26-27, 1998) (14 pages).
Hannegan, "Applications Widening for Rotating Control Heads," Drilling Contractor, cover page, table of contents and pp. 17 and 19, Drilling Contractor Publications Inc., Houston, Texas, Jul. 1996.
Composite Catalog, Hughes Offshore 1986-87 Subsea Systems and Equipment, Hughes Drilling Equipment Composite Catalog (pp. 2986-3004).
Williams Tool Co., Inc. Technical Specifications Model for The Model 7100, (3 pages).
Williams Tool Co., Inc. Website, Underbalanced Drilling (UBD), The Attraction of UBD (2 pages).
Williams Tool Co., Inc. Website,. "Applications, Where Using a Williams Rotating Control Head While Drilling is a Plus" (2 pages).
Williams Tool Co., Inc. Website, "Model 7100,"(3 pages).
Composite Catalog, Hughes Offshore 1982/1983, Regan Products, © Copyright 1982 (Two cover sheets and 4308-27 thru 4308-43, and end sheet). See p. 4308-36 Type KFD Diverter.
Coflexip Brochure; 1-Coflexip Sales Offices, 2-the Flexible Steel Pipe for Drilling and Service Applications, 3-New 5 I.D. General Drilling Flexible, 4-Applications, and 5-Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System).
Brochure, Lock down Lubricator System, Dutch Enterprises, Inc., "Safety with Savings" (cover sheet and 16 unnumbered pages); see above US Patent No. 4,836,289 referred to therein.
Hydril GL series Annual Blowout Preventers (Patented—see Roche patents above), (cover sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562-1568).
Avoiding Explosive Unloading of Gas in a Deep Water Riser When SOBM in Use; Colin P. Leach & Joseph R. Roche—1998 (The Paper Describes an Applicaton for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266).
Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater" SPE/IACDC 52787 Presented by Don Hannegan, P.E., SPE © SPE/IADC Drilling Conference, Amsterdam, Holland, Mar. 9-11, 1999 (5 unnumbered pages).
Brochure: "Inter-Tech Drilling Solutions, Ltd.'s RBOP™ Means Safety and Experience for Underbalanced Drilling," Inter-Tech Drilling Solutions Ltd./Big D Rentals & Sales (1981) Ltd. and Color Copy of "Rotating BOP" (2 unnumbered pages).
"Pressure Control While Drilling," Shaffer® A Varco Company, Rev. A (2 unnumbered pages).
Field Exposure (As of Aug. 1998), Shaffer® A Varco Company (1 unnumbered page).
Graphic: "Rotating Spherical BOP" (1 unnumbered page).
"JIP's Worl Brightens Outlook for UBD in Deep Waters"by Edson Yoshihito Nakagawa, Helio Santos and Jose Carlos Cunha, American Oil & Gas Reporter, Apr. 1999, pp. 53, 56, 58-60 and 63.
"Seal-Tech 1500 PSI Rotating Blowout Preventer," Undated, 3 pages.
"RPM System 3000™ Rotating Blowout Preventer, Setting a new standard in Well Control,"by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS Well Control Workshop: An overview," by John Rogers Smith. World Oil, Jun. 1999. Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D.O. Nessa, "Offshore underbalanced drilling system could revive field developments," World Oil Exploration Drilling Production, vol. 218, No. 7, Color pages of Cover Page and pp. 3, 61-64, and 66, Jul. 1997.
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship," Cover Page and pp. 114-121. Undated but cited in above US Patent No. 6,230,824B1.
"History and Development of a Rotating Preventer," by A. Cress, Rick Stone, and Mike Tangedahl, IADC/SPE 23931, Feb. 1992, pp. 757-773.
Helio Santos, Email message to Don Hannegan, et al., 1 page (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10 (2002).
Williams Tool Company Inc., "Risercap™: Rotating Control Head System For Floating Drilling Rig Applications," 4 unnumbered pages, ( © 1999 Williams Tool Company, Inc.).
Antonio C.V.M. Lage, Helio, Santos and Paulo R.C. Silva, Drilling with Aerated Drilling Fluid From a Floating Unit Part 2: Drilling the Well, SPE 71361, 11 pages ( © 2001, Society of Petroleum Engineers, Inc.).
Helio Santos, Fabio Rosa, and Christian Leuchtenberg, Drilling and Aerated Fluid from a Floating Unit, Part 1: Planning, Equipment, Tests, and Rig Modifications, SPE/IADC 67748, 8 pages ( © 2001 SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, ( © 1999, Society of Petroleum Engineers).

(56) References Cited

OTHER PUBLICATIONS

E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/200000831.asp, 2 pages (Aug. 31, 2000).
Press Release: "Stewart & Stevenson introduces First Dual Gradient Riser," Stewart & Stevenson, http:www/ssss/com/ssss/200000831.asp, 2 pages (Aug. 31, 2000).
Williams Tool Company Inc., "Williams Tool Company Introduces the . . . Virtual Riser™," 4 unnumbered pages, ( © 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover Page and pp. 2-13 (Jun. 17, 2002).
Colbert, John W., "John W. Colbert, P.E. Vice President Engineering Bioraphical Data," Signa Engineering Corp., 2 unnumbered pages (undated).
"Technical Training Courses," Parker Drilling Co., http:/www.parkerdrilling.com/news/tech.html, 5 pages (last visited, Sep. 5, 2003).
"Drilling equipment: Improvements from data recording to slim hole," Drilling Contractor, pp. 30-32, (Mar. 30-32, (Mar./Apr. 2000).
"Drilling conference promises to be informative," Drilling Contractor, p. 10 (Jan./Feb. 2002).
"Underbalanced and Air Drilling," OGCI, Inc., http:/www.ogci.com/course_info.asp?counsel=410, 2 pages., (2003).
"2003 SPE Calendar," Society of Petroleum Engineers, Google cache of http:/www.spe.org/spe/cda/view/events/eventMaster/0,1470,1648_2194_632303.00html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002).
"Weatherford UnderBalanced Services: General Underbalanced Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003).
Forrest, Neil et al., Subsea Equipment for Deep Water Drilling Using Dual Gradient Mud System, SPE/IASC Drilling Conference held in Amsterdam, The Netherlands, Feb. 27. 2001 to Mar. 1, 2001, Paper SPE/IADC 67707, © 2001 SPE/IADC Drilling Conference (8 pages); particularly see. p. 3, col. 1, ¶ 4 and col. 2, ¶ 5 and FIGS. 4-6; cited in 7V below where indicated as "technical background".
Hannegan, D.M.; Bourgoyne, Jr., A.T.: "Deepwater Drilling with Lightweight Fluid—Essential Equipment Required," SPE/IADC 67708, pp. 1-6 ( © 2001, SPE/IADC Drilling Conference).
Hannegan, Don M., "Underbalanced Operations Continue Offshore Movement," SPE 68491, pp. 1-3, ( © 2001, Society of Petroleum Engineers, Inc.).
Hannegan, D. and Divine, R., "Underbalanced Drilling—Perceptions and Realities of Today's Technology in Offshore Applications," IADC/SPE 74448, p. 1-9, ( © 2002, IADC/SPE Drilling Conference).
Hannegan, Don M. and Wanzer, Glen: "Well Control Considerations—Offshore Applications of Underbalanced Drilling Technology," SPE/IADC 79854, pp. 1-14, ( © 2003, SPE/IADC Drilling Conference).
Bybee, Karen, "Offshore Applications of Underbalanced—Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998).
Lage, Antonio C.V.M.; Santos, Helio; Silva, Paulo R.C.; "Drilling With Aerated Drilling Fluid From a Floating Unit Part 2: Drilling the Well," Society of Petroleum Engineers, SPE 71361, pp. 1-11 (Sep. 30-Oct. 3, 2001)(see document BBB).
Furlow, William; "Shell's seafloor pump, solids removal key to ultra-deep, dual-gradient drilling (Skid ready for commercialization)," Offshore World Trends and Technology for Offshore Oil and Gas Operations, Cover page, table of contents, pp. 54, 2 unnumbered pages, and 106 (June 2001).
Rowden, Michael V.: "Advances in riserless drilling pushing the deepwater surface string envelope (Alternative to seawater, CaCl12 sweeps);" Offshore World Trends and Technology for Offshore Oil and Gas Operations, Cover page, table of contents, pp. 56, 58, and 106 (Jun. 2001).
Boye, John: "Multi Purpose Intervention Vessel Presentation," M.O.S.T. Multi Operational Service Tankers, Weatherford International, Jan. 2004, 43 pages ( © 2003).
GB Search Report, International Application No. GB 0324939.8, 1 page (Jan. 21, 2004).
MicroPatent® list of patents citing US Patent No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International No. PCT/EP2004/052167, 6 pages.
Supplementary European Search Report No. EP 99908371, 3 pages (Date of Completion Oct. 22, 2004).
*General Catalog*, 1970-71, Vetco Offshore, Inc., Subsea Systems; cover page, company page and numbered pp. 4800, 4816-4818; 6 pages total, in particular see numbered p. 4816 for "patented"Vetco H-4 connectors.
*General Catalog*, 1972-73, Vetco Offshore, Inc., Subsea Systems; cover page; company page and numbered pp. 4498, 4509-4510; 5 pages total.
*General Catalog*, 1974-75, Vetco Offshore, Inc.; cover page, company page and numbered pp. 5160, 5178-5179; 5 pages.
*General Catalog*, 1976-1977, Vetco Offshore, Inc., Subsea Drilling and Completion Systems; cover page and numbered pp. 5862-5863; 4 pages total.
*General Catalog*, 1982-1983, Vetco; cover page and numbered pp. 8454-8455, 8479; 4 pages total.
*Shaffer, A Varco Company: Pressure Control While Drilling System*, http:/www.tulsaequipm.com; printed Jun. 21, 2004; 2 pages.
*Performance Drilling by Precision Drilling. A Smart Equation*, Precision Drilling, © Precision Drilling Corporation; 12 pages, in particular see 9th page for "Northland's patented RBOP . . . ".
*RPM System, 3000™ Rotating Blowout Preventer: Setting a New Standard in Well Control*, Weatherford, Underbalanced Systems: © 2002-2005 Weatherford: Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford, 28 pages.
Hold™ 2500 RCD Rotating Control Devices web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling from A Semi-Submersible Drilling Rig," J.H. Terwogt, SPE, L.B. Makiaho and N. van Beelan, SPE, Shell Malaysia Explosion and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).

(56) References Cited

OTHER PUBLICATIONS

Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006, corresponding to U.S. Appl. No. 10/995,980, published as US2006/0108119 A1 (now US 7,487,837 B2) (5 pages).
Netherlands Search Report for NL No. 1026044, dated Dec. 14, 2005 (3 pages).
Int'l. Search Report for PCT/GB 00/00731 corresponding to US :Patent No. 6,470,975 (Jun. 16, 2000) (2 pages).
GB0324939.8 Examination Report corresponding to US Patent No. 6,470,975 (Mar. 21, 2006) (6 pages).
GB0324939.8 Examination Report corresponding to US Patent No. 6,470,975 Jan. 22, 2004) (3 pages).
2003/0106712 Family Lookup Report (Jun. 15, 2006) (5 pages).
6,470,975 Family Lookup Report (Jun. 15, 2006) (5 pages).
AU S/N 28183/00 Examination Report corresponding to US Patent No. 6,470,975 (1 page) (Sep. 9, 2002).
NO S/N 20013953 Examination Report corresponding to US Patent No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997).
Int'l. Search Report for PCT/GB 00/00731 corresponding to US Patent No. 6, 470,975 (4 pages) (Jun. 27, 2000).
Int'l. Preliminary Examination Report for PCT/GB 00/00731 corresponding to US Patent No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to US Patent No. 6,263,982 (1 page) (Sep. 6, 2002).
EU Examination Report for WO 00/906522.8-2315 corresponding to US Patent No. 6,263,982 (4 pages) (Nov. 29, 2004).
NO S/N 20013952 Examination Report w/two pages of English translation corresponding to US Patent No. 6,263,982 (4 pages) (Jul. 2, 2005).
PCT/GB00/00726 Int'l. Preliminary Examination Report corresponding to US Patent No. 6,263,982 (10 pages) (Jun. 26, 2001).
PCT/GB00/00726 Written Opinion corresponding to US Patent No. 6,263,982 (7 pages) (Dec. 18, 2000).
PCT/GB00/00726 International Search Report corresponding to US Patent No. 6,263,982 (3 pages (Mar. 2, 1999).
AU S/N 27822/99 Examination Report corresponding to US Patent No. 6,138,774 (1 page) (Oct. 15, 2001).
EU 99908371.0-1266-US99/03888 European Search Report corresponding to US Patent No. 6,138,774 (3 pages) (Nov. 2, 2004).
NO S/N 20003950 Examination Report w/one page of English translation corresponding to US Patent No. 6,138,774 (3 pages) (Nov. 1, 2004).
PCT/US990/03888 Notice of Transmittal of International Search Report corresponding to US Patent No. 6,138,774 (6 pages) (Aug. 4, 1999).
PCT/US99/03888 Written Opinion corresponding to US Patent No. 6,138,744 (5 pages) (Dec. 21, 1999).
PCT/US99/03888 Notice of Transmittal of International Preliminary Examination Report corresponding to US Patent No. 6,138,774 (15 pages) (Jun. 12, 2000).
EU Examination Report for 05270083.8-2315 corresponding to U.S. Appl. No. 10/995,980, published as US 2006/0108119 A1 (now US 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, No. 10, Oct. 1992, numbered pp. 63-64 and 66 (3 pages) XP 000288328 ISSN: 0043-8790 (see YYYY, 5X above).
UK Search Report for Application No. GB 0325423.2; searched Jan. 30, 2004 corresponding to above US Patent No. 7,040,394 (one page).
UK Examination Report for Application No. GB 0325423.2 (4 pages).
Dietle, Lannie L. et al., Kalsi Seals Handbook, Document. 2137 Revision 1, © 1992-2005 Kalsi Engineering, Inc. of Sugar Land, Texas USA; front and back covers and 164 total pages; in particular forward page ii for "Patent Rights"; Appendix A-6 for Kalsi seal part No. 381-6- and A-10 for Kalsi seal part No. 432-32-. as discussed in U.S. Appl. No. 11/366,078 (now U S 7,836,946 B2) at number paragraph 70 and 71.
FIG. 10 and discussion in U.S. Appl. No. 11/366,078, published as US2006/0144622 A1 (now U S 7,836,946 B2) of Background of Invention.
Partial European search report R.46 EPC dated Jun. 27, 2007 for European Patent Application EP07103416.9-2315 corresponding to U.S. Appl. No. 11/366,078, published as US 2006/0144622 A1, now US Patent 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now US patent 7,836,946 (8 pages).
U.S. Appl. No. 60/079,641, Mudlift System for Deep Water Drilling, filed Mar. 27, 1998, abandoned, but priority claimed in above US 6,230,824 B1 and 6,102,673 and PCT WO-99/50524 (54 pages).
U.S. Appl. No. 60/122,530, Concepts for the Application of Rotating Control Head Technology to Deepwater Drilling Operations, filed Mar. 2, 1999, abandoned, but priority claimed in above US 6,470,975 B1 (54 pages).
PCT/GB2008/050239 (corresponding to US2008/0210471 A1; now issued as US 7,926,593) Annex to Form PCT/ISA/206 Communication Relating to the Results of the Partial International Search dated Aug. 26, 2008 (4 pages).
PCT/GB2008/050239 (corrsponding to US2008/0210471 A1; now issued as US 7,926,593) International Search Report and Written Opinion of the International Searching Authority (19 pages).
Vetco Gray Product Information CCDE-PI-0007 dated Mar. 1999 for 59.0" Standard Bore CSO Diverter (2 pages) © 1999 By Vetco Gray Inc.
Vetco Gray Capital Drilling Equipment KFDJ and KFDJ Model"J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16"-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16 RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).

(56) References Cited

OTHER PUBLICATIONS

Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Application (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see Figs. 14-20; cited in 7V below where indicatied as "document cited for other reasons".
Turck Works Industrial Automation; Factor 1 Sensing for Metal Detection, cover page, first page and numbered pp. 1.157 to 1.170 (16 pages) (printed in Jan. 2009).
Balluff Sensors Worldwide; Object Detection Catalog 08/09—Industrial Proximity Sensors for Non-Contact Detection of Metallic Targets at Ranges Generally under 50mm (2 inches); Linear Position and Measurement; Linear Position Transducer; Inductive Distance Sensors; Photoelectric Distance Sensors; Magneto-Inductive Linear Position Sensors; Magnetic Linear/Rotary Encoder System; printed Dec. 23, 2008 (8 pages).
Inductive Sensors AC 2-Wire Tubular Sensores, Balluff product catalog pp. 1.109-1.120 (12 pages) (no date).
Inductive Sensors DC 2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors DC 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 pages) (www.. spaceagecontrol.com/selpt.htm).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1, now US Patent No. 7,836,946 B2 (3 pages).
Response to European Patent Application No. 08719084.9 (corresponding to the present published application US2008/0210471 A1, now issued as US 7,926,593) dated Nov. 16, 2010 (4 pages).
Office Action from the Canadian Intellectual Property Office dated Apr. 15, 2008 for Canadian Application No. 2,527,395 corresponding to U.S. Appl. No. 10/995,980, published as US-2006/0108119 A1, now US Patent No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now US Patent No. 7,487,837 B2 (2 pages).
Office Action from the Canadian Intellectual Property Office dated Dec. 15, 2009 for Canadian Application No. 2,681,868 corresponding to U.S. Appl. No. 10/995,980, published as US-2006/0108119 A1, now US Patent No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-2006/0108119 A1, now US Patent No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1, now US Patent No. 7,487,837 B2 (2 pages).
Web page of Ace Wire Spring & Form Company, Inc. printed Dec. 8, 2009 for "Garter Springs—Helical Extension & Compression" www..acewirespring.com/garter-springs.html (1 page).
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Grosso, J.A., "An Analysis of Well Kicks on Offshore Floating Drilling Vessels," SPE 4134, Oct. 1972, pp. 1-20, © 1972 Society of Petroleum Engineers (20 pages).
Bourgoyne, Jr., Adam T., et al., "Applied Drilling Engineering," pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition (9 pages).
Rasmussen, Ovle Sunde, et al., "Evaluation of MPD Methods for Compensation of Surge-and-Swab Pressure in Drilling Operations," IADC/SPE 108346, Mar. 2007, pp. 1-11, © 2007 IADC/SPE Managed Pressure Drilling and Underbalanced Operations Conference and Exhibition (11 pages).
Shaffer Drill String Compensator available from National Oilwell Varco of Houston, Texas, printed Mar. 23, 2010 from http://www.nov.com/ProductDispay.aspx?ID=4954&taxID=121 &terms=drill+string+compensators (1 page).
Shaffer Crown Mounted Compensator available from National Oilwell Varco of Houston, Texas, printed Mar. 23, 2010 from http://www.nov.com/ProductDisplay.aspx?ID=4949&taxID=121 &terms=active+drill+string+compensator (3 pages).
Active heave compensator available from National Oilwell Varco of Houston, Texas, printed Mar. 23, 2010 from http://www.nov.com/ProductDisplay.aspx?ID=3677 &taxID=terms=active+heave+compensator (3 pages).
Durst, Doug, et al., "Subsea Downhole Motion Compensator (SDMC): Field History, Enhancements, and the Next Generation,"IADC/SPE 59152, Feb. 2000, pp. 1-12, © 2000 Society of Petroleum Engineers, Inc. (12 pages).
Sensoy, Taner, et al., Weatherford Secure Drilling Well Controlled Report "Surge and Swab effects d ue to the Heave motion of floating rigs", Nov. 10, 2009 (7 pages).
Hargreaves, David, et al., "Early Kick Detection for Deepwater Drilling: New Probabilistic Methods Applied in the Field" SPE 71369, © 2001, Society of Petroleum Engineers, Inc. (11 pages).
HH Heavy-Duty Hydraulic Cylinders catalog, The Sheffer Corporation printed Mar. 5, 2010 from http://www.sheffercorp.com/layout_contact.shtm (27 pages).
Unocal Baroness Surface Stack Upgrade Modifications (5 pages).

(56) References Cited

OTHER PUBLICATIONS

Thomson, William T., Professor of Engineering, University of California, "Vibration Theory and Applications" 1848, 1953, 1965 by Prentice-Hall, Inc. title page, copyright page, contents page and numbered pp. 3-9 (10 pages).

Active Heave Compensator, Ocean Drilling Program, www.oceandrilling.org (3 pages).

3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).

Weatherford® Real Results First Rig Systems Solutions for Thailand Provides Safer, More Efficient Operations with Stabmaster® and Automated Side Doors, © 2009 Weatherford document No. 6909.00 discussing Weatherford's Integrated Safety Interlock System (ISIS) (1 page).

U.S. Appl. No. 61/205,209, filed Jan. 15, 2009; Abandoned, but priority claimed in US2010/0175882A1 (24 pages).

Smalley® Steel Ring Company, Sprirolox®; pages from website http://www.spirolox.com/what_happened.php printed Apr. 27, 2010 (5 pages).

Extended European Search Report (R 61 EPC) dated Feb. 22, 2012 for European Application No. 1015296.9-2315/2216498 corresponding to U.S. Appl. No. 12/322,860, published as US2009-0139724 A1 on Jun. 4, 2009 (our matter 63) (7 pages).

Extended European Search Report (R 61 EPC) dated Feb. 28, 2012 for European Application No. 10150906.5-2315/2208855 corresponding to U.S. Appl. No. 12/643,093, published as US2010-0175882 A1 on Jul. 15, 2010, now US Patent No. 8,322,432 issued Dec. 4, 2012 (our matter 64) (8 pages).

Canadian Office Action mailed from the Canadian Intellectual Property Office on May 13, 2013 in Application No. 2,690,289, corresponding to U.S. Appl. No. 12/643,093 resulting in US 8,322,432 B2 (2 pages) (our matter 64CA).

European Office Action mailed from the European Patent Office on May 24, 2013 in Application No. 10 150 906.5-1610, corresponding to U.S. Appl. No. 12/643,093 resulting in US 8,322,432 B2 advising that the Examining Division intends to grant a European patent based on this application (7 pages) (our matter 64EP).

* cited by examiner

SUBSEA INTERNAL RISER ROTATING CONTROL HEAD SEAL ASSEMBLY

CROSS-REFERENCE TO RELATED APPLICATIONS

This application is a divisional of co-pending U.S. Non-Provisional patent application Ser. No. 12/643,093, filed Dec. 21, 2009, which claims the benefit of U.S. Provisional Application No. 61/205,209, filed on Jan. 15, 2009, both of which are hereby incorporated by reference for all purposes in their entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention generally relates to subsea drilling system and method, and in particular to a system and method adapted for use with a rotating control device (RCD) to sealably control fluid flow in a riser.

2. Description of Related Art

Marine risers extending from a wellhead fixed on the floor of an ocean have been used to circulate drilling fluid back to a structure or rig. The riser must be large enough in internal diameter to accommodate the largest bit and pipe that will be used in drilling a borehole into the floor of the ocean.

An example of a marine riser and some of the associated drilling components is proposed in U.S. Pat. Nos. 4,626,135 and 7,258,171. As shown in FIG. 1 of the '171 patent, since the riser R is fixedly connected between a floating structure or rig S and the wellhead W, a conventional slip or telescopic joint SJ, comprising an outer barrel OB and an inner barrel IB with a pressure seal therebetween, is used to compensate for the relative vertical movement or heave between the floating rig and the fixed riser. A diverter D has been connected between the top inner barrel IB of the slip joint SJ and the floating structure or rig S to control gas accumulations in the marine riser R or low pressure formation gas from venting to the rig floor F. A ball joint BJ above the diverter D compensates for other relative movement (horizontal and rotational) or pitch and roll of the floating structure S and the fixed riser R.

The diverter D can use a rigid diverter line DL extending radially outwardly from the side of the diverter housing to communicate drilling fluid or mud from the riser R to a choke manifold CM, shale shaker SS or other drilling fluid receiving device. Above the diverter D is the rigid flow line RF, configured to communicate with the mud pit MP. If the drilling fluid is open to atmospheric pressure at the bell-nipple in the rig floor F, the desired drilling fluid receiving device must be limited by an equal height or level on the structure S or, if desired, pumped by a pump to a higher level. While the shale shaker SS and mud pits MP are shown schematically in FIG. 1 of the '171 patent, if a bell-nipple were at the rig floor F level and the mud return system was under minimal operating pressure, these fluid receiving devices may have to be located at a level below the rig floor F for proper operation. Since the choke manifold CM and separator MB are used when the well is circulated under pressure, they do not need to be below the bell nipple.

As also shown in FIG. 1 of the '171 patent, a conventional flexible choke line CL has been configured to communicate with choke manifold CM. The drilling fluid then can flow from the choke manifold CM to a mud-gas buster or separator MB and a flare line (not shown). The drilling fluid can then be discharged to a shale shaker SS, and mud pits MP. In addition to a choke line CL and kill line KL, a booster line BL can be used.

In the past, when drilling in deepwater with a marine riser, the riser has not been pressurized by mechanical devices during normal operations. The only pressure induced by the rig operator and contained by the riser is that generated by the density of the drilling mud held in the riser (hydrostatic pressure). During some operations, gas can unintentionally enter the riser from the wellbore. If this happens, the gas will move up the riser and expand. As the gas expands, it will displace mud, and the riser will "unload." This unloading process can be quite violent and can pose a significant fire risk when gas reaches the surface of the floating structure via the bell-nipple at the rig floor F. As discussed above, the riser diverter D, as shown in FIG. 1 of the '171 patent, is intended to convey this mud and gas away from the rig floor F when activated. However, diverters are not used during normal drilling operations and are generally only activated when indications of gas in the riser are observed. The '135 patent proposed a gas handler annular blowout preventer GH, such as shown in FIG. 1 of the '171 patent, to be installed in the riser R below the riser slip joint SJ. Like the conventional diverter D, the gas handler annular blowout preventer GH is activated only when needed, but instead of simply providing a safe flow path for mud and gas away from the rig floor F, the gas handler annular blowout provider GH can be used to hold limited pressure on the riser R and control the riser unloading process. An auxiliary choke line ACL is used to circulate mud from the riser R via the gas handler annular blowout preventer GH to a choke manifold CM on the rig.

More recently, the advantages of using underbalanced drilling, particularly in mature geological deepwater environments, have become known. Deepwater is generally considered to be between 3,000 to 7,500 feet deep and ultra deepwater is generally considered to be 7,500 to 10,000 feet deep. Rotating control heads or devices (RCD's), such as disclosed in U.S. Pat. No. 5,662,181, have provided a dependable seal between a rotating pipe and the riser while drilling operations are being conducted. U.S. Pat. No. 6,138,774, entitled "Method and Apparatus for Drilling a Borehole into a Subsea Abnormal Pore Pressure Environment," proposes the use of a RCD for overbalanced drilling of a borehole through subsea geological formations. That is, the fluid pressure inside of the borehole is maintained equal to or greater than the pore pressure in the surrounding geological formations using a fluid that is of insufficient density to generate a borehole pressure greater than the surrounding geological formation's pore pressures without pressurization of the borehole fluid. U.S. Pat. No. 6,263,982 proposes an underbalanced drilling concept of using a RCD to seal a marine riser while drilling in the floor of an ocean using a rotatable pipe from a floating structure. Additionally, U.S. Provisional Application No. 60/122,350, filed Mar. 2, 1999, entitled "Concepts for the Application of Rotating Control Head Technology to Deepwater Drilling Operations" proposes use of a RCD in deepwater drilling.

It has also been known in the past to use a dual density mud system to control formations exposed in the open borehole. See Feasibility Study of a Dual Density Mud System for Deepwater Drilling Operations by Clovis A. Lopes and Adam T. Bourgoyne, Jr., © 1997 Offshore Technology Conference. As a high density mud is circulated from the ocean floor back to the rig, gas is proposed in this May of 1997 paper to be injected into the mud column at or near the ocean floor to lower the mud density. However, hydrostatic control of abnormal formation pressure is proposed to be maintained by a weighted mud system that is not gas-cut below the ocean floor. Such a dual density mud system is proposed to reduce drilling costs by reducing the number of casing strings required to drill the well and by reducing the diameter requirements of the marine riser and subsea blowout preventers. This dual density mud system is similar to a mud nitrification system, where nitrogen is used to lower mud density, in that formation fluid is not necessarily produced during the drilling process.

As proposed in U.S. Pat. No. 4,813,495, a subsea RCD has been proposed as an alternative to the conventional drilling system and method when used in conjunction with a subsea pump that returns the drilling fluid to a drilling vessel. Since the drilling fluid is returned to the drilling vessel, a fluid with additives may economically be used for continuous drilling operations. ('495 patent, col. 6, ln. 15 to col. 7, ln. 24) Therefore, the '495 patent moves the base line for measuring pressure gradient from the sea surface to the mudline of the sea floor ('495 patent, col. 1, lns. 31-34). This change in positioning of the base line removes the weight of the drilling fluid or hydrostatic pressure contained in a conventional riser from the formation. This objective is achieved by taking the fluid or mud returns at the mudline and pumping them to the surface rather than requiring the mud returns to be forced upward through the riser by the downward pressure of the mud column ('495 patent, col. 1, lns. 35-40).

Conventional RCD assemblies have been sealed with a subsea housing active sealing mechanisms in the subsea housing. Additionally, conventional RCD assemblies, such as proposed by U.S. Pat. No. 6,230,824, have used powered latching mechanisms in the subsea housing to position the RCD.

Additionally, the use of a RCD assembly in a dual-density drilling operation can incur problems caused by excess pressure in either one of the two fluids. The ability to relieve excess pressure in either fluid would provide safety and environmental improvements. For example, if a return line to a subsea mud pump plugs while mud is being pumped into the borehole, an overpressure situation could cause a blowout of the borehole. Because dual-density drilling can involve varying pressure differentials, an adjustable overpressure relief technique has been desired.

Another problem with conventional drilling techniques is that moving of a RCD within the marine riser by tripping in hole (TIH) or pulling out of hole (POOH) can cause undesirable surging or swabbing effects, respectively, within the well. Further, in the case of problems within the well, a desirable mechanism should provide a "fail safe" feature to allow removal of the RCD upon application of a predetermined force.

U.S. Pat. Nos. 6,470,975; 7,159,669; and 7,258,171 propose positioning an RCD assembly in a housing positioned in a marine riser. In the '171 patent, a system and method are disclosed for drilling in the floor of an ocean using a rotatable pipe. The system uses a RCD with a bearing assembly and a holding member for removably positioning the bearing assembly in a subsea housing. The bearing assembly is sealed with the subsea housing by a seal, providing a barrier between two different fluid densities. The holding member resists movement of the bearing assembly relative to the subsea housing. The bearing assembly is proposed to be connected with the subsea housing above or below the seal.

In one embodiment of the '171 patent, the holding member rotationally engages and disengages a passive internal formation of the subsea housing. In another embodiment of the '171 patent, the holding member engages the internal formation, disposed between two spaced apart side openings in the subsea housing, without regard to the rotational position of the holding member. The holding member of the '171 patent is configured to release at predetermined force.

The holding member assembly of the '171 patent provides an internal housing concentric with an extendible portion. When the extendible portion extends, an upper portion of the internal housing is proposed to move toward a lower portion of the internal housing to extrude an elastomer disposed between the upper and lower portions to seal the holding member assembly with the subsea housing. The extendible portion is proposed to be dogged to the upper portion or the lower portion of the internal housing depending on the position of the extendible portion.

As further proposed in the '171 patent, a running tool is used for moving the rotating control head assembly with the subsea housing and is also used to remotely engage the holding member with the subsea housing.

Latching assemblies have been proposed in the past for positioning an RCD. U.S. Pat. No. 7,487,837 proposes a latch assembly for use with a riser for positioning an RCD. Pub. No. US 2006/0144622 A1 proposes a latching system to latch an RCD to a housing and active seals. Pub. No. US 2008/0210471 A1 proposes a docking station housing positioned above the surface of the water for latching with an RCD.

The above discussed U.S. Pat. Nos. 4,626,135; 4,813,495; 5,662,181; 6,138,774; 6,230,824; 6,263,982; 6,470,975; 7,159,669; 7,258,171; and 7,487,837; and Pub. Nos. US 2006/0144622 A1 and 2008/0210471 A1; and U.S. Provisional Application No. 60/122,350, filed Mar. 2, 1999, entitled "Concepts for the Application of Rotating Control Head Technology to Deepwater Drilling Operations" are all hereby incorporated by reference for all purposes in their entirety. The '181, '774, '982 and '171 patents, and the '622 and '471 publications are assigned to the assignee of the present invention.

In cases where reasonable amounts of gas and small amounts of oil and water are produced while drilling underbalanced for a small portion of the well, it would be desirable to use conventional rig equipment in combination with a RCD, to control the pressure applied to the well while drilling. Therefore, a system and method for sealing with a subsea housing including, but not limited to, a blowout preventer while drilling in deepwater or ultra deepwater that would allow a quick rig-up and release using conventional pressure containment equipment would be desirable. In particular, a system that provides sealing of the riser at any predetermined location, or, alternatively, is capable of sealing the blowout preventer while rotating the pipe, where the seal could be relatively quickly installed, and quickly removed, would be desirable.

BRIEF SUMMARY OF THE INVENTION

A system and method are disclosed for positioning a RCD with a riser spool or housing disposed with a marine riser. Latching members may be disposed in the housing for positioning the RCD with the housing. An internal bypass channel or line in the housing or an external bypass line disposed with the housing may be used with a valve, such as a gate valve, to allow fluid to bypass the RCD seals and the seal between the RCD and the housing. The riser housing latching members and/or packer seal may be operated remotely, such as through the use of a remotely operated vehicle (ROV), hydraulic lines, and/or an accumulator. The housing active packer seal may be hydraulically expanded or inflated for sealing the annular space between the housing and the RCD.

In other embodiments, the RCD may have an RCD holding member with a mechanically extrudable seal for sealing the RCD with the riser housing. The RCD may be positioned in the riser housing with an RCD running tool. In some embodiments, the holding member seal is mechanically extruded or set with a downward movement of the running tool after the RCD holding member is latched in the riser housing. In other embodiments, the holding member mechanically extrudable seal is set with an upward movement of the running tool after the RCD holding member is latched with the riser housing a loss motion connection.

BRIEF DESCRIPTION OF THE DRAWINGS

A better understanding of the present invention can be obtained with the following detailed descriptions of the various disclosed embodiments in the drawings, which are given by way of illustration only, and thus are not limiting the invention, and wherein.

DETAILED DESCRIPTION OF THE INVENTION

Generally, a sealing system and method for a rotatable tubular using an RCD positioned in a marine riser is disclosed. An RCD may have an inner member rotatable relative to an outer member about thrust and axial bearings, such as RCD Model 7875, available from Weatherford International of Houston, Tex., and other RCDs proposed in the '181, '171 and '774 patents. Although certain RCD types and sizes are shown in the embodiments, other RCD types and sizes are contemplated for all embodiments, including RCDs with different numbers, configurations and orientations of passive seals, and/or RCDs with one or more active seals.

Figure 1:
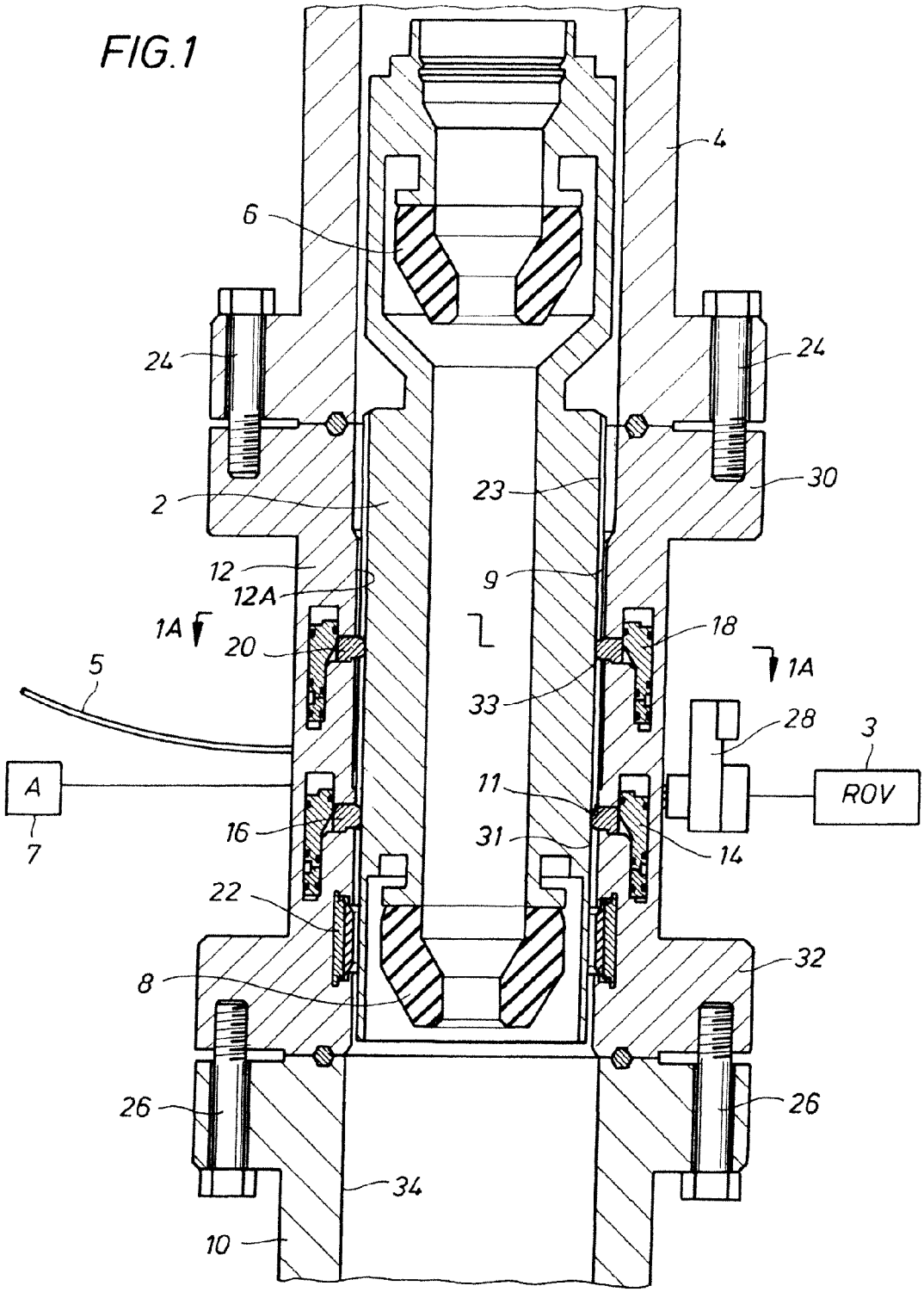
FIG. 1 is a cross-sectional elevational view of an RCD having two passive seals and latched with a riser spool or housing having two latching members shown in the latched position and an active packer seal shown in the unsealed position.
Figure 1A:
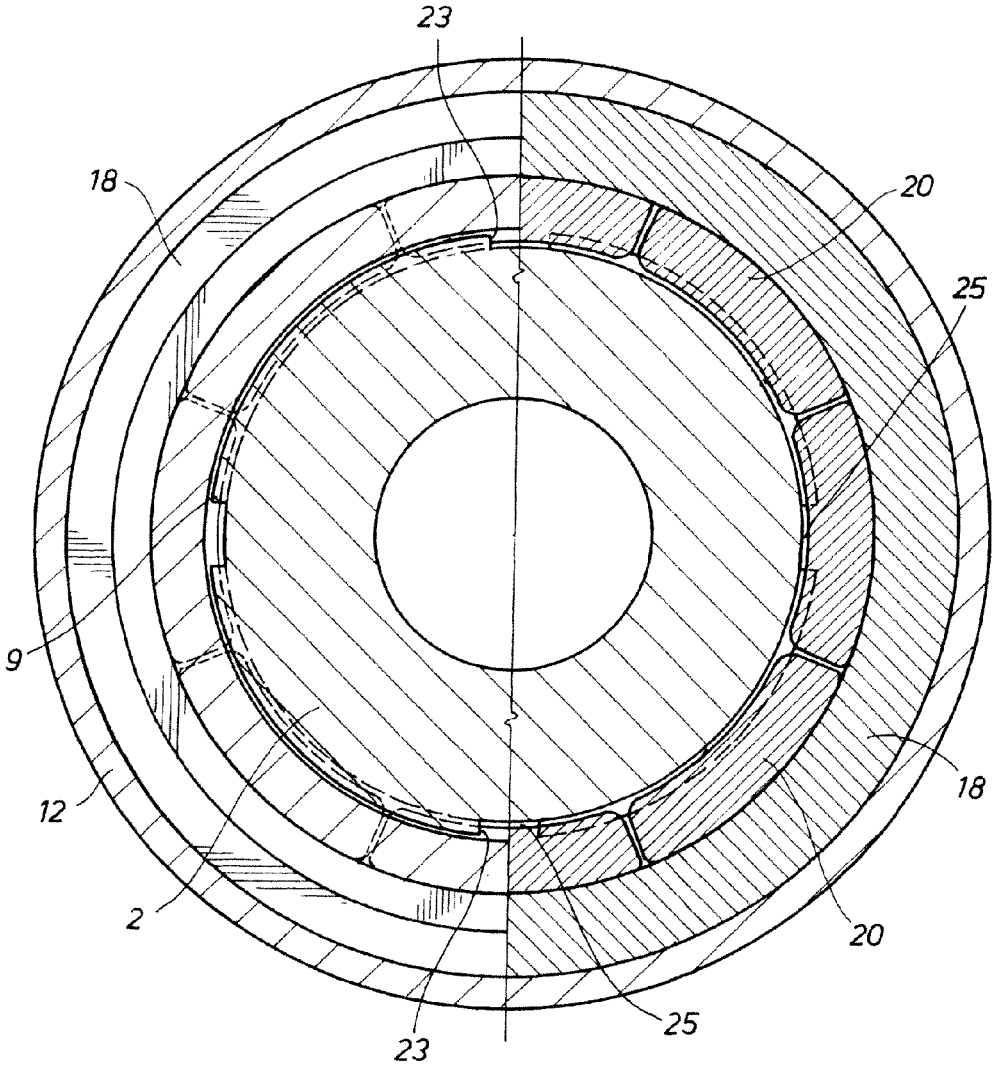

In FIG. 1, riser spool or housing 12 is positioned with marine riser sections (4, 10). Marine riser sections (4, 10) are part of a marine riser, such as disclosed above in the Background of the Invention. Housing 12 is illustrated bolted with bolts (24, 26) to respective marine riser sections (4, 10). Other attachment means are contemplated. An RCD 2 with two passive stripper seals (6, 8) is landed in and latched to housing 12 using first latching member 14 and second latching member 18, both of which may be actuated by hydraulic pistons, such as described in the '837 patent (see FIGS. 2 and 3 of '837 patent). Active packer seal 22 in housing 12, shown in its noninflated and unsealed position, may be hydraulically expandable to a sealed position to sealingly engage the outside diameter of RCD 2. Remote Operated Vehicle (ROV) subsea control panel 28 may be positioned with housing 12 between protective flanges (30, 32) for operation of hydraulic latching members (14, 18) and active packer seal 22. An ROV 3 containing hydraulic fluid may be sent below sea level to connect with the ROV panel 28 to control operations the housing 12 components. The ROV 3 may be controlled remotely from the surface. In particular, by supplying hydraulic fluid to different components using shutter valves and other mechanical devices, latching members (14, 18) and active seal 22 may be operated. Alternatively, or in addition for redundancy, one or more hydraulic lines, such as line 5, may be run from the surface to supply hydraulic fluid for remote operation of the housing 12 latching members (14, 18) and active seal 22. Alternatively, or in addition for further redundancy and safety, an accumulator 7 for storing hydraulic fluid may be activated remotely to operate the housing 12 components or store fluids under pressure. It is contemplated that all three means for hydraulic fluid would be provided.

The RCD 2 outside diameter is smaller than the housing 12 inside diameter or straight thru bore. First retainer member 16 and second retainer member 20 have been moved from their respective first or unlatched positions to their respective second or latched positions as they are shown in FIG. 1. First retainer member 16 blocks movement of the RCD 2 by contacting RCD blocking shoulder 11 and second retainer member 20 has engaged the RCD receiving formation 9 to squeeze the RCD between retainers (16, 20) to resist rotation. Retainer members (16, 20) may be a plurality of dogs or C-shaped members. Other retainer member configurations are contemplated. In their first or unlatched positions, retainer members (16, 20) allow clearance between the RCD 2 and housing 12. In their second or latched positions, retainer members (16, 20) block and latchingly engage the RCD 2, respectively, to resist vertical movement and rotation.

While it is contemplated that housing 12 may have a 10,000 psi body pressure rating, other pressure ratings are contemplated. Also, while it is contemplated that the opposed housing flanges (30, 32) may have a 39 inch (99.1 cm) outside diameter, other sizes are contemplated. RCD 2 may be latchingly attached with a 21.250 inch (54 cm) thru bore 34 of marine riser sections (4, 10) with a 19.25 (48.9 cm) inch inside bore 12A of housing 12. Other sizes are contemplated. It is also contemplated that housing 12 may be positioned above or be integral with a marine diverter, such as a 59 inch (149.9 cm) inside diameter marine diverter. Other sizes are contemplated. The diverter will allow fluid moving down the drill pipe and up the annulus to flow out the diverter opening below the lower stripper seal 8 and the same active seal 22. Although active seal 22 is shown below the bearing assembly of the RCD 2 and below latching members (14, 18), it is contemplated that active seal 22 may be positioned above the RCD bearing assembly and latching members (14, 18). It is also contemplated that there may be active seals both above and below the RCD bearing assembly and latching members (14, 18). All types of seals, active or passive, as are known in the art are contemplated. While the active seal 22 is illustrated positioned with the housing 12, it is contemplated that the seal, active or passive, could instead be positioned with the outer surface of the RCD 2.

Figure 4A:
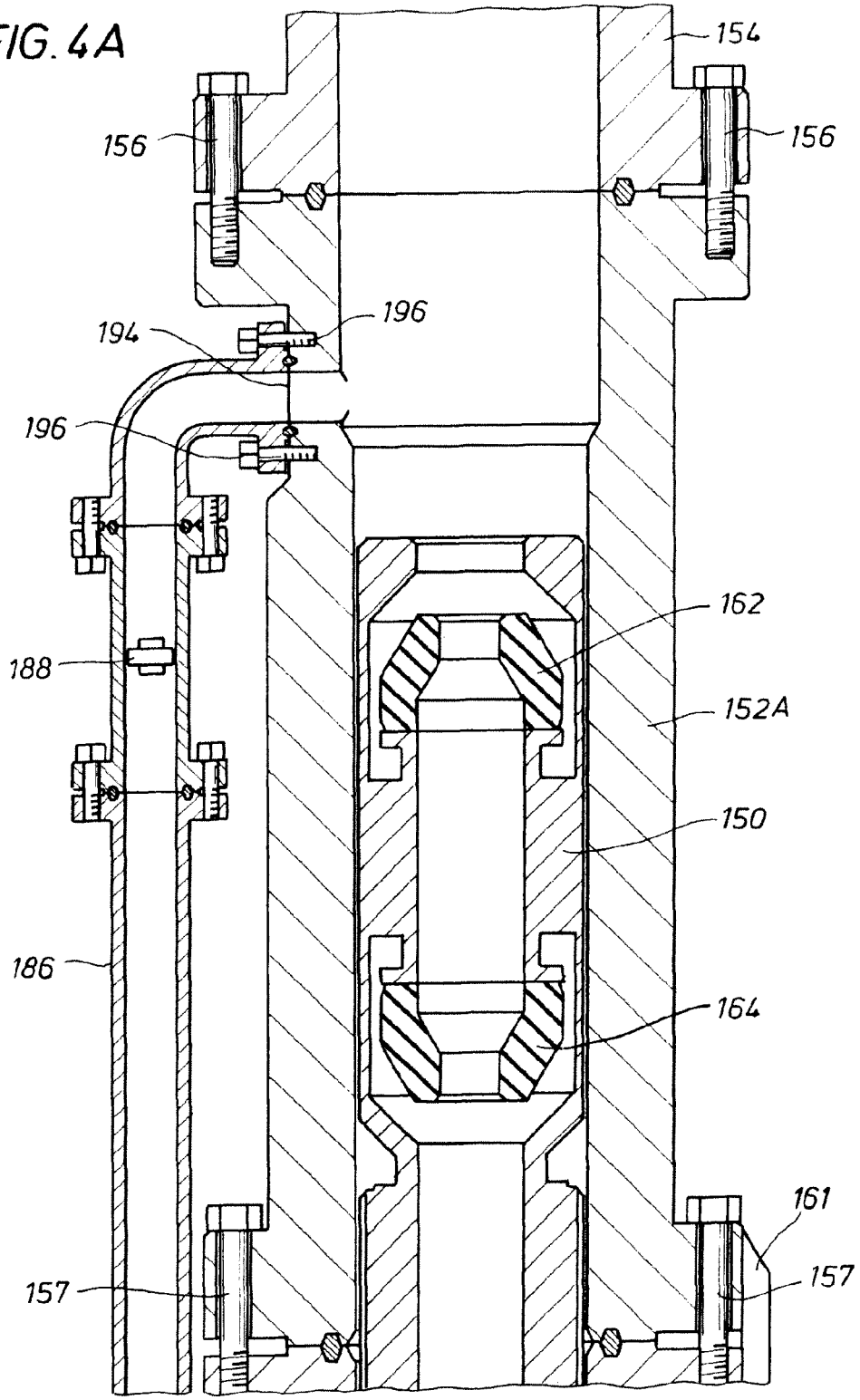
FIGS. 4A-4B are a cross-sectional elevational view of an RCD with three passive seals having a holding member disposed with an RCD running tool and latched with a riser spool or housing having three latching members shown in the latched position, the lower latch member engaging the holding member, and a bypass conduit or line having a valve therein.

In the preferred method, to establish a landing for RCD 2, which may be an 18.00 inch (45.7 cm) outer diameter RCD, the first retainer member 16 is remotely activated to the latched or loading position. The RCD 2 is then moved into the housing 12 until the RCD 2 lands with the RCD blocking shoulder 11 contacting the retainer member 16. The second retainer member 20 is then remotely activated with hydraulic fluid supplied as discussed above to the latched position to engage the RCD receiving formation 9, thereby creating a clamping force on the RCD 2 outer surface to, among other benefits, resist torque or rotation. In particular, the top chamfer on first retainer member 16 is engaged with the RCD shoulder 11. When the bottom chamfer on the second retainer member 20 moves into receiving formation 9 on the RCD 2 outer surface, the bottom chamfer "squeezes" the RCD between the two retainer members (16, 20) to apply a squeezing force on the RCD 2 to resist torque or rotation. The active seal 22 may then be expanded with hydraulic fluid supplied as discussed above to seal against the RCD 2 lower outer surface to seal the gap or annulus between the RCD 2 and the housing 12. The operations of the housing 12 may be controlled remotely through the ROV fluid supplied to the control panel 28, with hydraulic line 5 and/or accumulator 7. Other methods are contemplated, including activating the second retainer member 20 simultaneously with the active seal 22. Although a bypass channel or line, such as internal bypass channel 68 shown in FIG. 2 and external bypass line 186 shown in FIG. 4A, is not shown in FIG. 1, it is contemplated that a similar external bypass line or internal bypass channel with a valve may be used in FIG. 1 or in any other embodiment of the invention. The operation of a bypass line with a valve is discussed in detail below with FIG. 2.

Figure 2:
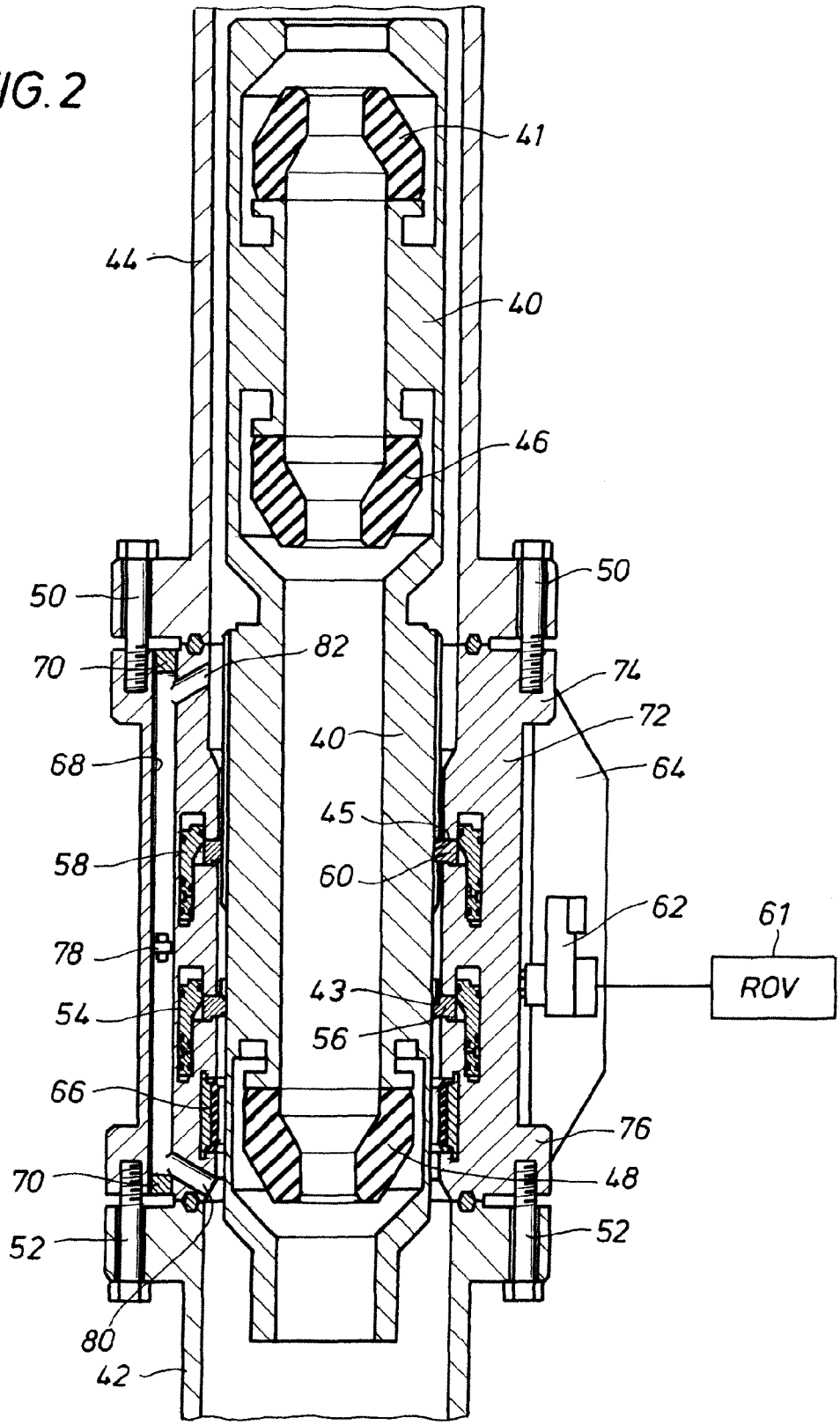
FIG. 2 is a cross-sectional elevational view of an RCD with three passive seals latched with a riser spool or housing having two latching members shown in the latched position, an active seal shown in the unsealed position, and a bypass channel or line having a valve therein.

Turning to FIG. 2, an RCD 40 with three passive stripper seals (41, 46, 48) is positioned with riser spool or housing 72 with first retainer member 56 and second retainer member 60, both of which are activated by respective hydraulic pistons in respective latching members (54, 58). First retainer member 56 blocks movement of the RCD 40 when blocking shoulder 43 engages retainer member 56 and second retainer member 60 is positioned with RCD receiving formation 45. The operations of the housing 72 components may be controlled remotely using ROV 61 connected with ROV control panel 62 positioned between flanges (74, 76) and further protected by shielding member 64. Alternatively, or in addition, as discussed above, housing 74 components may be operated by hydraulic lines and/or accumulators. RCD stripper seal 41 is inverted from the other stripper seals (46, 48) to, among other reasons, resist "suck down" of drilling fluids during a total or partial loss circulation. Such a loss circulation could result in the collapse of the riser if no fluids were in the riser to counteract the outside forces on the riser.

The RCD 40 outside diameter is smaller than the housing 72 inside diameter, which may be 19.25 inches (48.9 cm). Other sizes are contemplated. While the riser housing 72 may have a 10,000 psi body pressure rating, other pressure ratings are contemplated. Retainer members (56, 60) may be a plurality of dogs or a C-shaped member, although other types of members are contemplated. Active seal 66, shown in an unexpanded or unsealed position, may be expanded to sealingly engage RCD 40. Alternatively, or in addition, an active seal may be positioned above the RCD bearing assembly and latching members (54, 58). Housing 74 is illustrated bolted with bolts (50, 52) to marine riser sections (42, 44). As discussed above, other attachment means are contemplated. While it is contemplated that the opposed housing flanges (74, 76) may have a 45 inch (114.3 cm) outside diameter, other sizes are contemplated. As can now be understood, the RCD 40 may be latchingly attached with the thru bore of housing 72. It is also contemplated that housing 74 may be positioned with a 59 inch (149.9 cm) inside diameter marine diverter.

The system shown in FIG. 2 is generally similar to the system shown in FIG. 1, except for internal bypass channel 68, which, as stated above, may be used with any of the embodiments. Valve 78, such as a gate valve, may be positioned in bypass channel 68. Two end plugs 70 may be used after internal bypass channel 68 is manufactured, such as shown in FIG. 2, to seal communication with atmospheric pressure outside the wellbore. Bypass channel 68 with gate valve 78 acts as a check valve in well kick or blowout conditions. Gate valve 78 may be operated remotely. For example, if hazardous weather conditions are forecasted, the valve 78 could be closed with the riser sealable controlled and the offshore rig moved to a safer location. Also, if the riser is raised with the RCD in place, valve 78 could be opened to allow fluid to bypass the RCD 40 and out the riser below the housing 72 and RCD 40. In such conditions, fluid may be allowed to flow through bypass channel 68, around RCD 40, via bypass channel first end 80 and bypass channel second end 82, thereby bypassing the RCD 40 sealed with housing 72. Alternatively to internal bypass channel 68, it is contemplated that an external bypass line, such as bypass line 186 in FIG. 4A, may be used with FIG. 2 and any other embodiments.

Figure 3A:
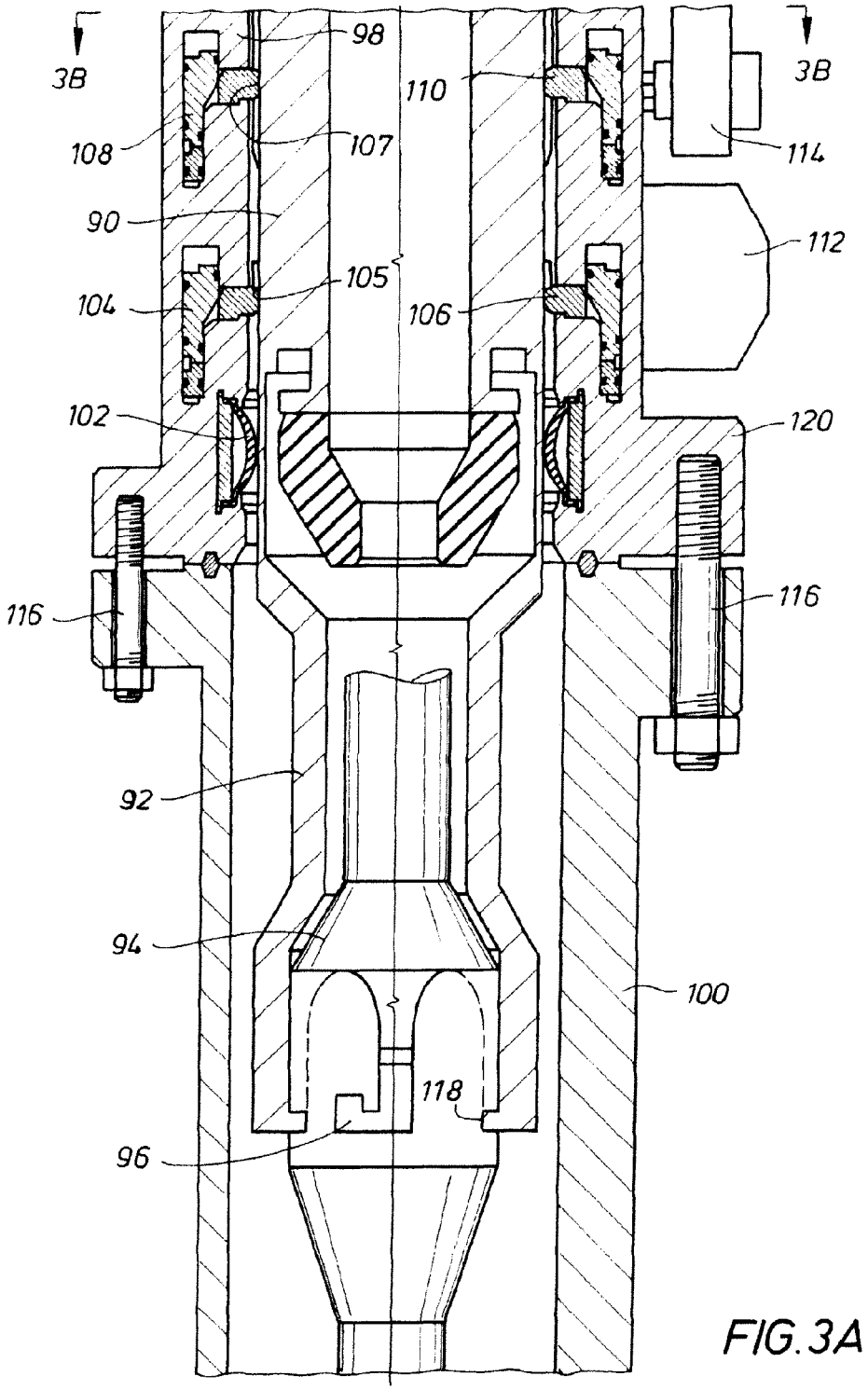
FIG. 3A is a cross-sectional elevational partial view of an RCD having a holding member disposed with an RCD running tool and latched with a riser spool or housing having two latching members shown in the latched position and an active seal shown in the sealed position.

In FIG. 3A, riser spool or housing 98 is illustrated connected with threaded shafts and nuts 116 to marine riser section 100. An RCD 90 having a holding member 92 is positioned with an RCD running tool 94 with housing 98. Holding member latching formations 118 may be positioned in the J-hook receiving grooves 96 in RCD running tool 94 so that the running tool 94 and RCD 90 are moved together on the drill string through the marine riser and housing 98. Other attachment means are contemplated as are known in the art. A running tool, such as running tool 94, may be used to position an RCD with any riser spool or housing embodiments. RCD 90 is landed with housing 98 with first retainer member 106 and squeezed with second retainer member 110, both of which are remotely actuated by respective hydraulic pistons in respective latching members (104, 108). First retainer member 106 blocks RCD shoulder 105 and second retainer member 110 is positioned with RCD second receiving formation 107.

ROV control panel 114 may be positioned with housing 98 between upper and lower shielding protrusions 112 (only lower protrusion shown) to protect the panel 114. Other shielding means are contemplated. While it is contemplated that the opposed housing flanges 120 (only lower flange shown) of housing 98 may have a 45 inch (114.3 cm) outside diameter, other sizes are contemplated. The RCD 90 outside diameter is smaller than the housing 98 inside diameter. Retainer members (106, 110) may be a plurality of dogs or a C-shaped member. Active seal 102, shown in an expanded or sealed position, sealingly engages RCD 102. After the RCD 90 is sealed as shown in FIG. 3A, the running tool 94 may be disengaged from the RCD holding member 92 and continue moving with the drill string down the riser for drilling operations. Alternatively, or in addition, an active or passive seal may be positioned on RCD 90 instead of on housing 98, and/or may be positioned both above and below RCD bearing assembly or latching members (104, 108). Alternatively to the embodiment shown in FIG. 3A, a holding member, such as holding member 92, may be positioned above the RCD bearing assembly or latching members (104, 108) to engage an RCD running tool. The alternative holding member may be used to either house a seal, such as seal 102, or be used as the portion of the RCD to be sealed by a seal in a housing, similar to the embodiment shown in FIG. 3A.

Figure 3B:
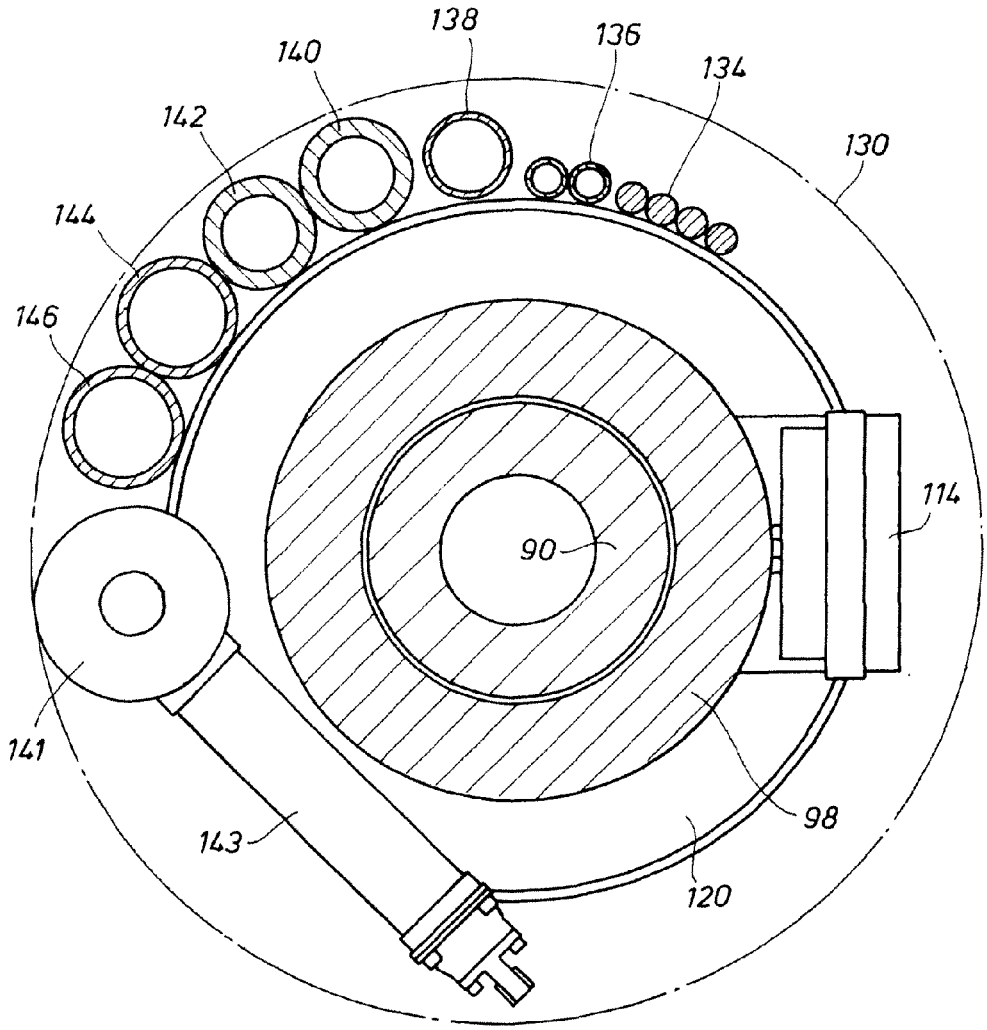
FIG. 3B is a section view along line 3B-3B of FIG. 3A showing an ROV panel and an exemplary placement of lines, such as choke lines, kill lines and/or booster lines, cables and conduits around the riser spool.

Generally, lines and cables extend radially outwardly from the riser, as shown in FIG. 1 of the '171 patent, and male and female members of the lines and cables plug together as the riser sections are joined together. Turning to FIG. 3B, an exemplary placement of lines and cables is shown external to housing 98 and within the inside diameter 130 of a marine diverter as the lines and cables traverse across the housing 98. Exemplary lines and cables may include 1.875 inch OD multiplex cables 134, 2.375×2.000 rigid conduit lines 136, a 5.563×4.5 mud boost line 138, a 7×4.5 kill line 140, a 7×4.5 choke line 142, a 7.5×6 mud return line 144, and a 7.5×6 sea water fluid power line 146. Other sizes, lines and cables and configurations are contemplated. It is also contemplated that an ROV or accumulator(s) may be used to replace some of the lines and/or conduits. It is contemplated that a marine riser segment would stab the male or pin end of its riser tubular segment lines and cables with the female or box end of a lower riser tubular segment lines and cables. The lines and cables, such as shown in FIG. 3B, may also be stabbed or plugged with riser tubular segment lines and cables extending radially outward so that they may be plugged together when connecting the riser segments. In other words, the lines and/or cables shown in FIG. 3B are rerouted along the vertical elevation profile exterior to housing 98 to avoid housing protrusions, such as panel 114 and protrusion 112, but the lines and cables are aligned racially outward to allow them to be connected with their respective lines and cables from the adjoining riser segments. Although section 3B-3B is only shown with FIG. 3A, similar exemplary placement of the ROV panel, lines, and cables as shown in FIG. 3B may be used with any of the embodiments.

An external bypass line 186 with gate valve 188 is shown and discussed below with FIG. 4A. Although FIG. 3A does not show a bypass line and gate valve, it is contemplated that the embodiment in FIG. 3A may have a bypass line and gate valve. FIG. 3B shows an exemplary placement of a gate valve 141 with actuator 143 if used with FIG. 3A. A similar placement may be used for the embodiment in FIG. 4A and other embodiments.

Figure 4B:
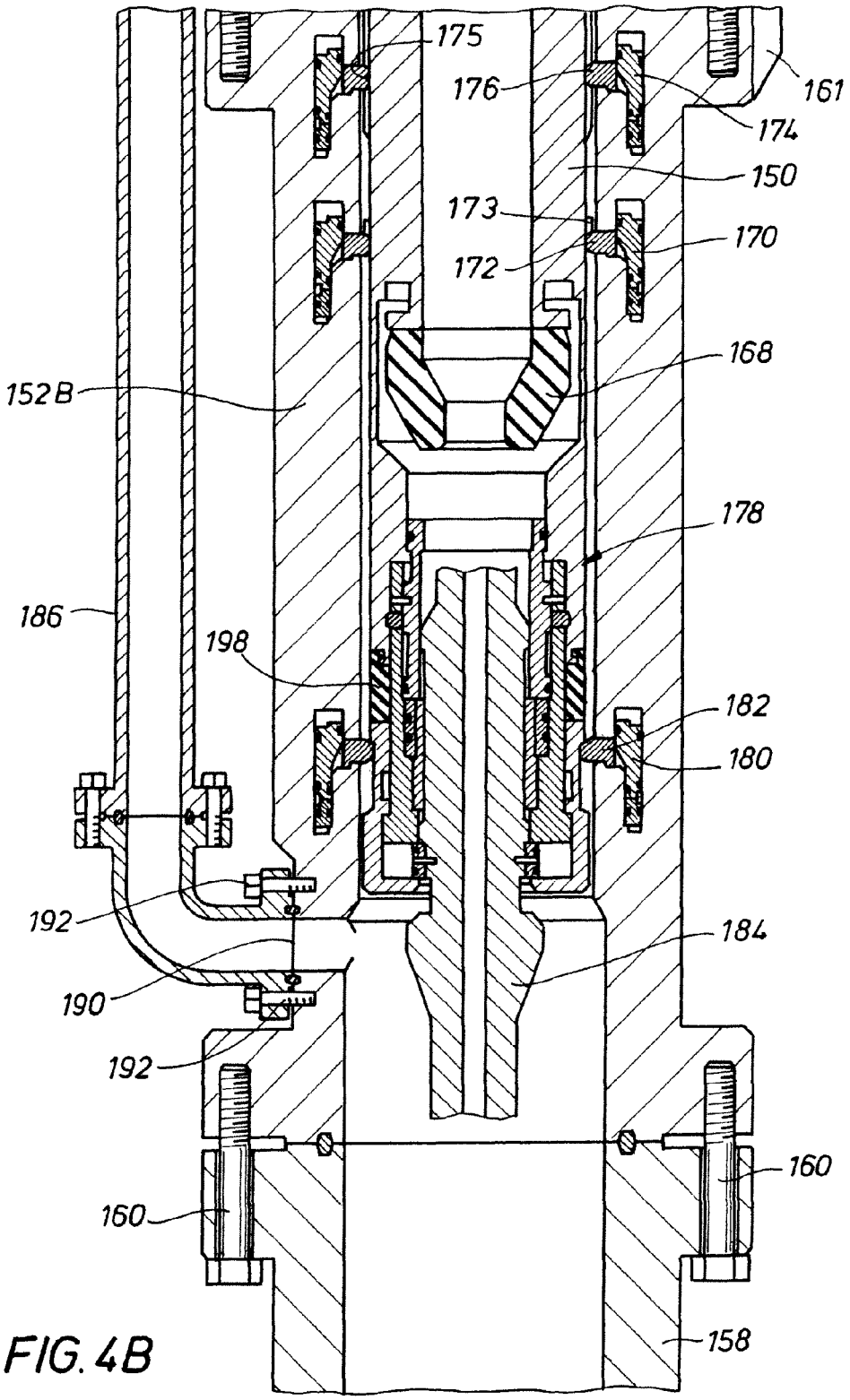

In FIGS. 4A-4B, riser spools or housings (152A, 152B) are bolted between marine riser sections (154, 158) with respective bolts (156, 160). Housing 152A is bolted with housing 152B using bolts 157. An RCD 150 with three passive stripper seals (162, 164, 168) is positioned with riser spools or housings (152A, 152B) with first retainer member 172, second retainer member 176, and third retainer member or holding member retainer 182 all of which are activated by respective hydraulic pistons in their respective latching members (170, 174, 180). Retainer members (172, 176, 182) in housing 152B as shown in FIG. 4B have been moved from their respective first or unlatched positions to their respective second or latched positions. First retainer member 172 blocks RCD shoulder 173 and second retainer member 176 is positioned with RCD receiving formation 175. The operations of the housing 152B may be controlled remotely using in any combination an ROV connected with an ROV containing hydraulic fluid and control panel, hydraulic lines, and/or accumulators, all of which have been previously described but not shown for clarity of the Figure.

The RCD holding member 178 for RCD 150 and the RCD running tool 184 are similar to the holding member and running tool shown in FIGS. 10A-10E and are described in detail below with those Figures. RCD stripper seal 162 is inverted from the other stripper seals (164, 168). Although RCD holding member 178 is shown below the RCD bearing assembly and below the first and second latching members (170, 174), a holding member may alternatively be positioned above the RCD bearing assembly and the first and second latching members (170, 174) for all embodiments.

External bypass line 186 with valve 188 may be attached with housing 152 with bolts (192, 196). Other attachment means are contemplated. A similar bypass line and valve may be positioned with any embodiment. Unlike bypass channel 68 in FIG. 2, bypass line 186 in FIGS. 4A-4B is external to and releasable from the housings (152A, 152B). Bypass line 186 with gate valve 188 acts as a check valve in well kick or blowout conditions. Gate valve 188 may be operated remotely. Also, if hazardous weather conditions are forecasted, the valve 188 could be closed with the riser sealable controlled and the offshore rig moved to a safer location.

Also, when the riser is raised with the RCD in place, valve 188 could be opened to allow fluid to bypass the RCD 150 and out the riser below the housing 152B and RCD 150. In such conditions when holding member extrudable seal 198 is in a sealing position (as described below in detail with FIGS. 10A-10E), fluid may be allowed to flow through bypass line 186, around RCD 150, via bypass line first end 190 and bypass line second end 194, thereby bypassing RCD 150 sealed with housing 152B. Alternatively to external bypass line 186, it is contemplated that an internal bypass channel, such as bypass channel 68 in FIG. 2, may be used with FIGS. 4A-4B and any other embodiment.

Figure 5A:
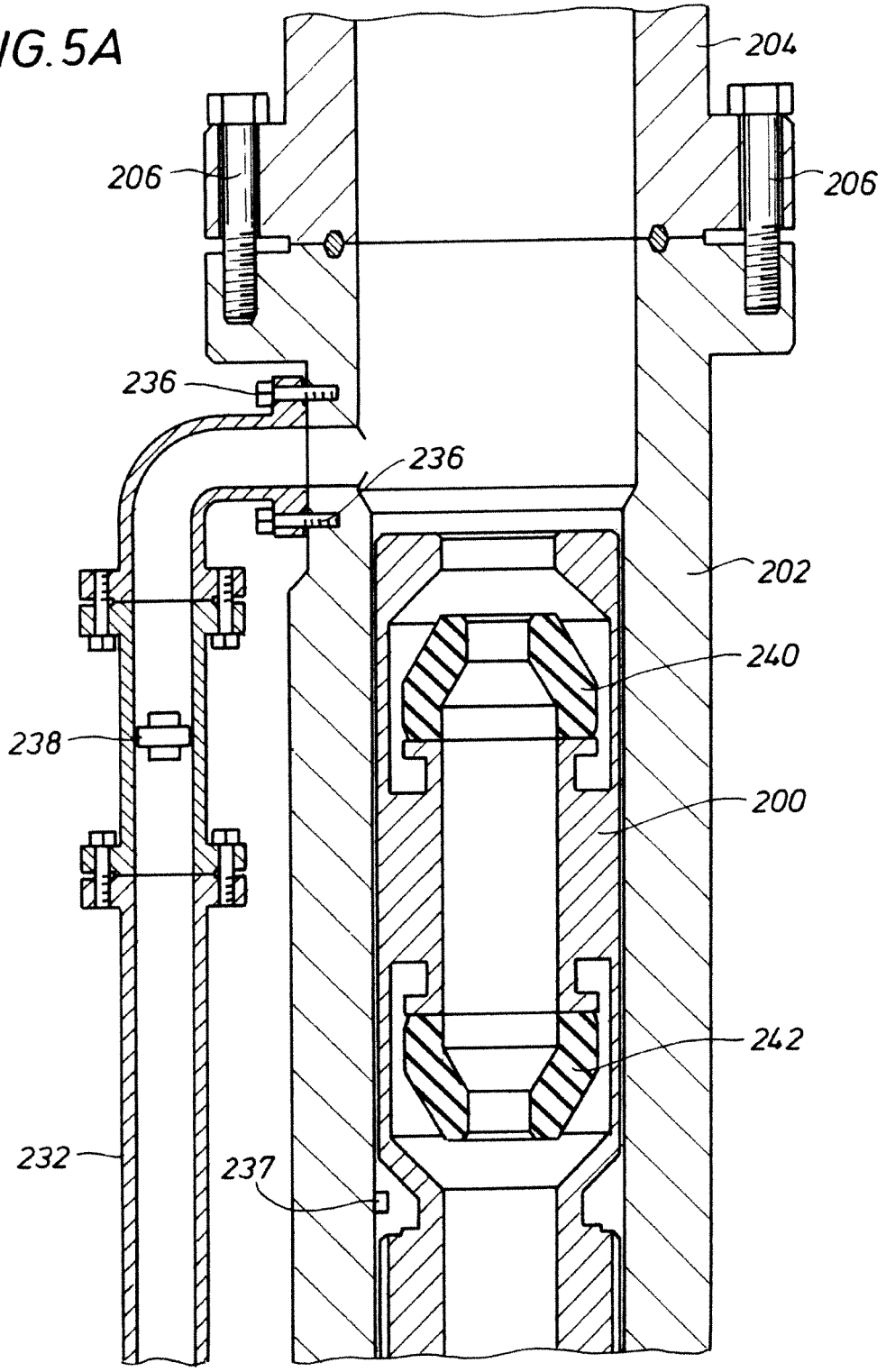
FIGS. 5A-5B are a cross-sectional elevational view of an RCD with three passive seals having a holding member disposed with an RCD running tool and sealed with a riser housing and the RCD latched with the riser housing having two latching members shown in the latched position and a bypass conduit or line having a valve therein.
Figure 5B:
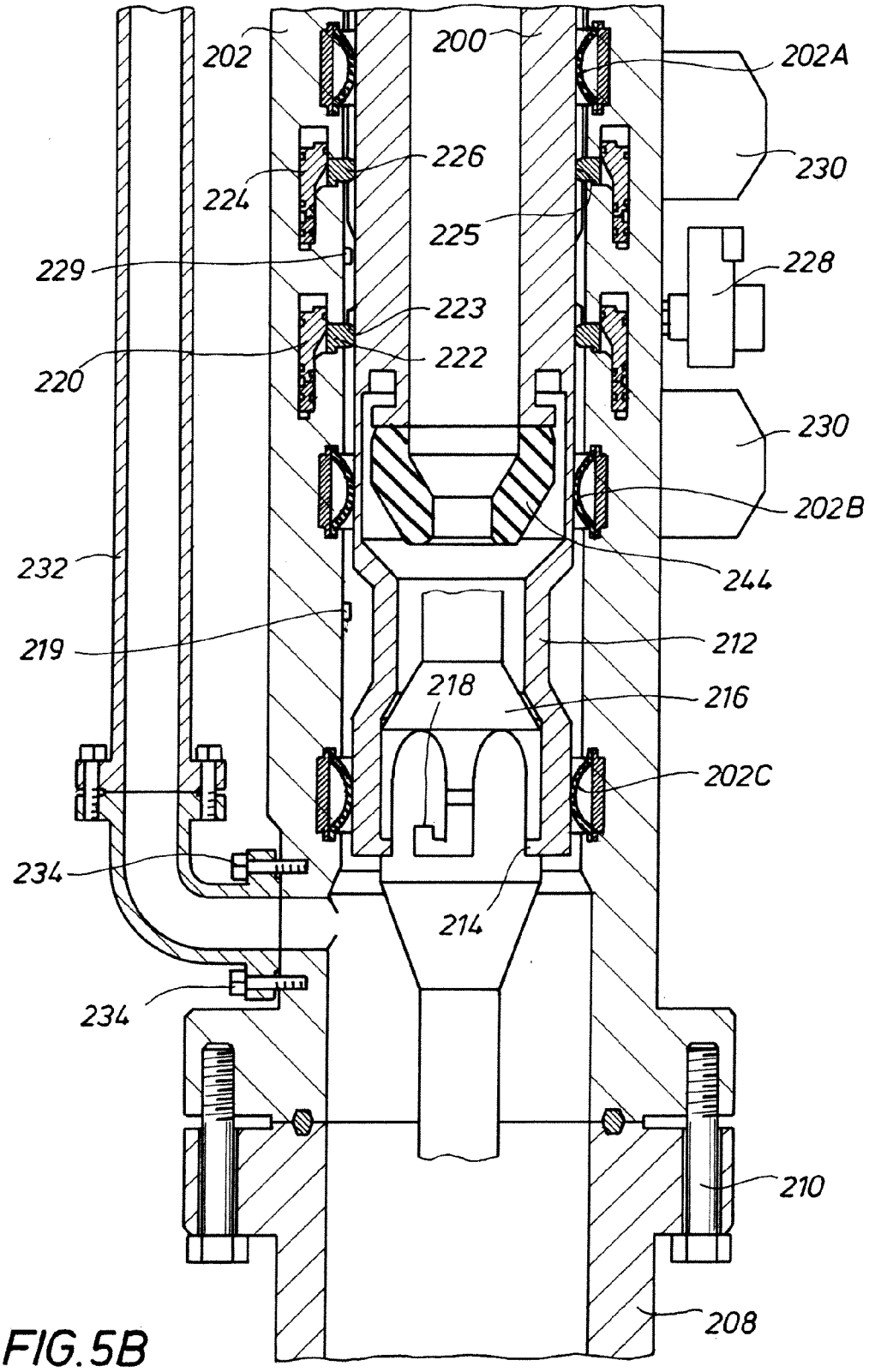

Turning to FIGS. 5A-5B, riser spool or housing 202 is illustrated bolted to marine riser sections (204, 208) with respective bolts (206, 210). An RCD 200 having three passive seals (240, 242, 244) and a holding member 212 is positioned with an RCD running tool 216 used for positioning the RCD 200 with housing 202. Holding member latching formations 214 may be positioned in the J-hook receiving grooves 218 in RCD running tool 216 and the running tool 216 and RCD 200 moved together on the drill string through the marine riser. RCD 200 is landed with housing 202 with first retainer member 222 and latched with second retainer member 226, both of which are remotely actuated by respective hydraulic pistons in respective latching members (220, 224). First retainer member 222 blocks RCD shoulder 223 and second retainer member 226 is positioned with RCD receiving formation 225. Active seals (202A, 202B, 202C) may be used to seal the annulus between the housing 202 and RCD 200. After the RCD 200 is latched and seated as shown in FIG. 5B, the running tool 216 may be disengaged from the RCD 200 and continue moving with the drill string down the riser for drilling operations.

ROV control panel 228 may be positioned with housing 200 between two shielding protrusions 230 to protect the panel 228. The RCD 200 outside diameter is smaller than the housing 202 inside diameter. Retainer members (222, 226) may be a plurality of dogs or a C-shaped member. External bypass line 232 with valve 238 may be attached with housing 202 with bolts (234, 236). Other attachment means are contemplated. Bypass line 232 with gate valve 238 acts as a check valve in well kick or blowout conditions. Valve 238 may be operated remotely.

Figure 6A:
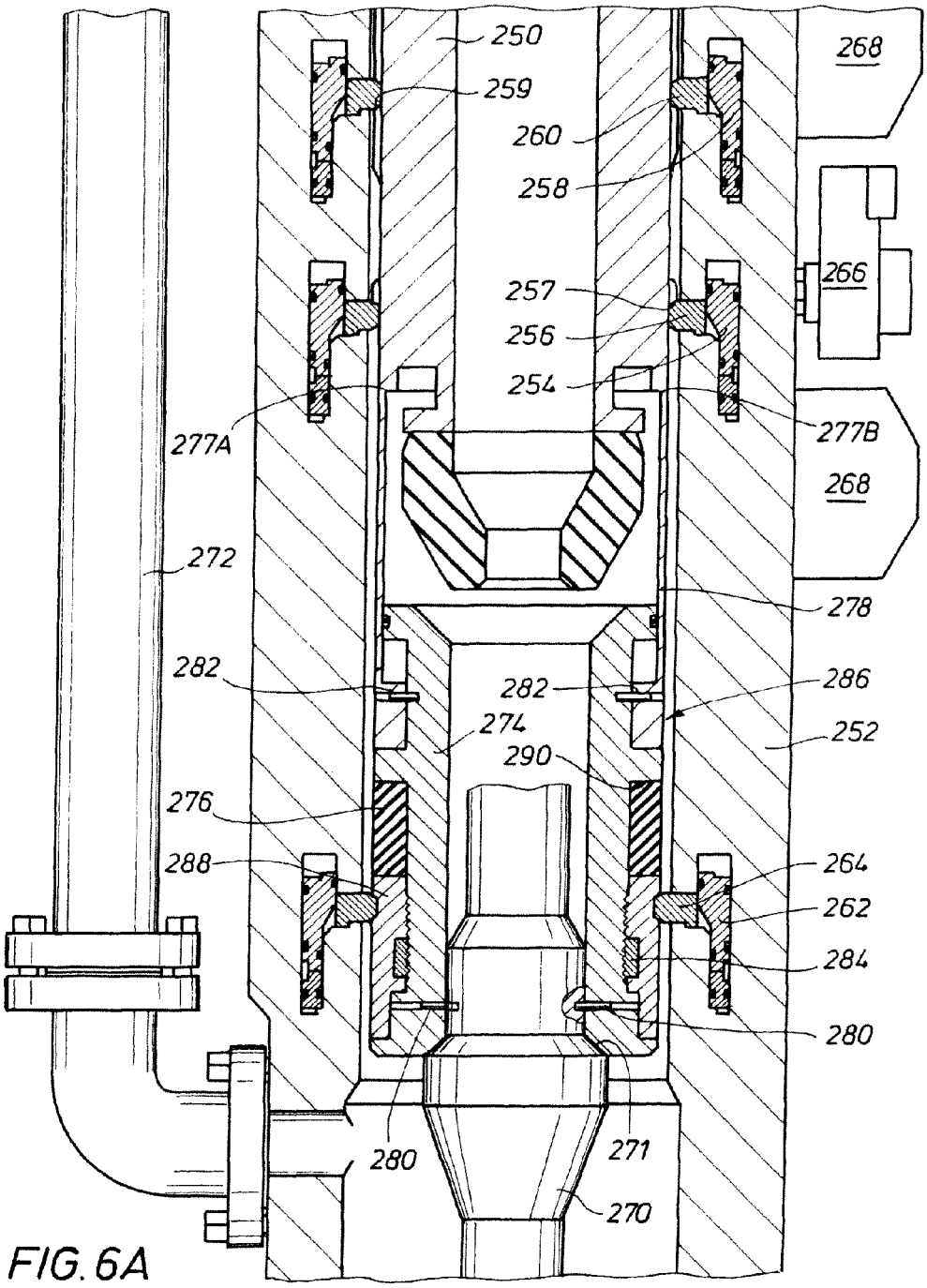
FIG. 6A is a cross-sectional elevational partial view of an RCD having a holding member with a mechanically extrudable holding member seal shown in the unsealed position, the holding member having two unsheared shear pins and a ratchet shear ring.

Turning to FIG. 6A, RCD 250 having a holding member, generally designated 286, is shown latched in riser spool or housing 252 with first retainer member 256, second retainer member 260, and third retainer member or holding member retainer 264 of respective latching members (254, 258, 262) in their respective second or latched/landed positions. First retainer member 256 blocks RCD shoulder 257 and second retainer member 260 is positioned with RCD receiving formation 259. An external bypass line 272 is positioned with housing 252. An ROV panel 266 is disposed with housing 252 between two shielding protrusions 268. Holding member 286 comprises RCD extension or extending member 278, tool member 274, retainer receiving member 288, holding member seal 276, upper or first shear pins 282, lower or second shear pins 280, and ratchet shear ring or ratchet shear 284. Although two upper 282 and two lower 280 shear pins are shown for this and other embodiments, it is contemplated that there may be only one upper 282 and one lower 280 shear pin or that there may be a plurality of upper 282 and lower 280 shear pins of different sizes, metallurgy and shear rating. Other mechanical shearing devices as are known in the art are also contemplated.

Holding member seal 276 may be bonded with tool member blocking shoulder 290 and retainer receiving member 288, such as by epoxy. A lip retainer formation in either or both the tool member 274 and retainer receiving member 288 that fits with a corresponding formation(s) in seal 276 is contemplated. This retainer formation, similar to formation 320 shown and/or described with FIG. 7A, allows seal 276 to be connected with the tool member 274 and/or retainer receiving member 288. A combination of bonding and mechanical attachment as described above may be used. Other attachment methods are contemplated. The attachment means shown and discussed for use with extrudable seal 276 may be used with any extrudable seal shown in any embodiment.

Figure 6B:
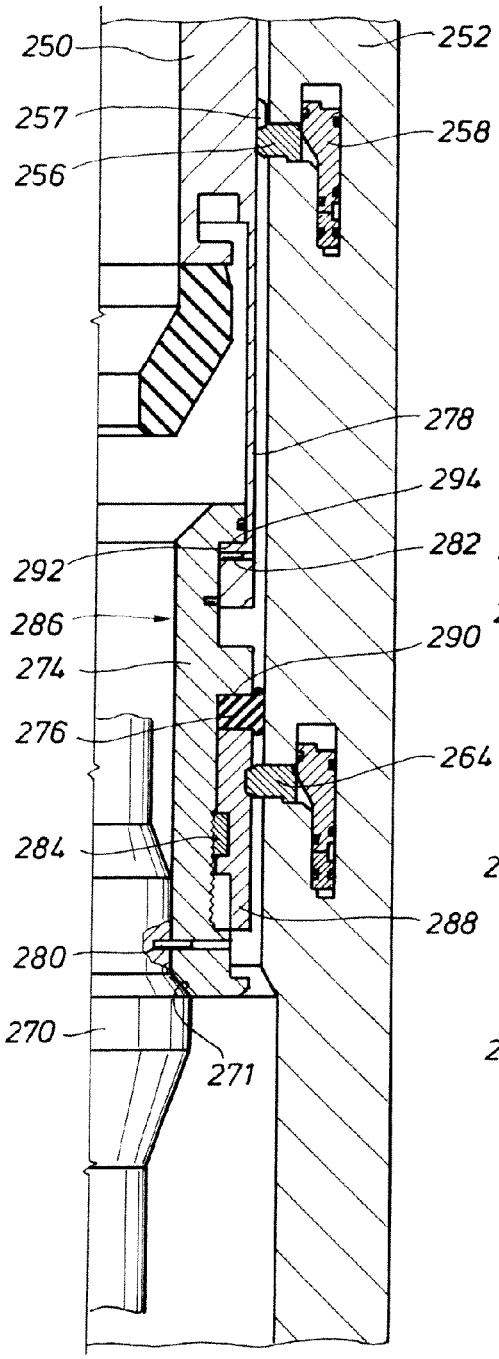
FIG. 6B is a cross-sectional elevational partial broken view of the RCD of FIG. 6A with the RCD running tool moved downward from its position in FIG. 6A to shear the holding member upper shear pin and ratchet the ratchet shear ring to extrude the holding member seal to the sealed position.

Holding member 286 is positioned with RCD running tool 270 with lower shear pins 280 and running tool shoulder 271. After the running tool is made up in the drill string, the running tool 270 and RCD 250 are moved together from the surface down through the marine riser to housing 252 in the landing position shown in FIG. 6A. In one method, it is contemplated that before the RCD 250 is lowered into the housing 252, first retainer member 256 would be in the landing position, and second 260 and third 264 retainer members would be in their unlatched positions. RCD shoulder 257 would contact first retainer member 256, which would block downward movement. Second retainer member 260 would then be moved to its latched position engaging RCD receiving formation 259, which, as discussed above, would squeeze the RCD between the first 256 and second 260 retaining members to resist rotation. Third retaining member would then be moved to its latched position with retainer receiving member 288, as shown in FIG. 6A. After landing, the holding member seal 276 may be extruded as shown in FIG. 6B. It should be understood that the downward movement of the running tool and RCD may be accomplished using the weight of the drill string.

FIG. 6B shows the setting position used to set or extrude holding member seal 276 to seal with housing 252. To set the extrudable seal 276, the running tool 270 is moved downward from the landing position shown in FIG. 6A. This downward motion shears the upper shear pin 282 but not the lower shear pin 280. This downward movement also ratchets the ratchet shear ring 284 upwardly. As can now be understood, lower shear pin 280 has a higher shear and ratchet force than upper shear pin 282 and ratchet shear ring 284, respectively, relative to retainer receiving member 288 and then maintains the relative position. Therefore, ratchet shear ring 284 allows the downward movement of the tool member 274. The running tool 270 pulls the tool member 274 down until the blocking shoulder 292 of the tool member 274 contacts the upward facing blocking shoulder 294 of RCD extending member 278. Shoulder 290 of tool member 274 compresses and extrudes seal 276 against retainer receiving member 288, which is held fixed by third retainer member 264. During setting, ratchet shear ring 284 allows tool member 274 to ratchet downward with minimal resistance and without shearing the ring 284. After the seal 276 is set as shown in FIG. 6B, running tool 270 may continue downward through the riser for drilling operations by shearing the lower shear pin 280. Ratchet shear ring 284 maintains tool member 274 from moving upward after the lower shear pin 280 is sheared, thereby keeping holding member seal 276 extruded as shown in FIG. 6B during drilling operations. As can now be understood, for the embodiment shown in FIGS. 6A-6C, the weight of the drill string moves the running tool 270 downward for setting the holding member seal 276.

Figure 6C:
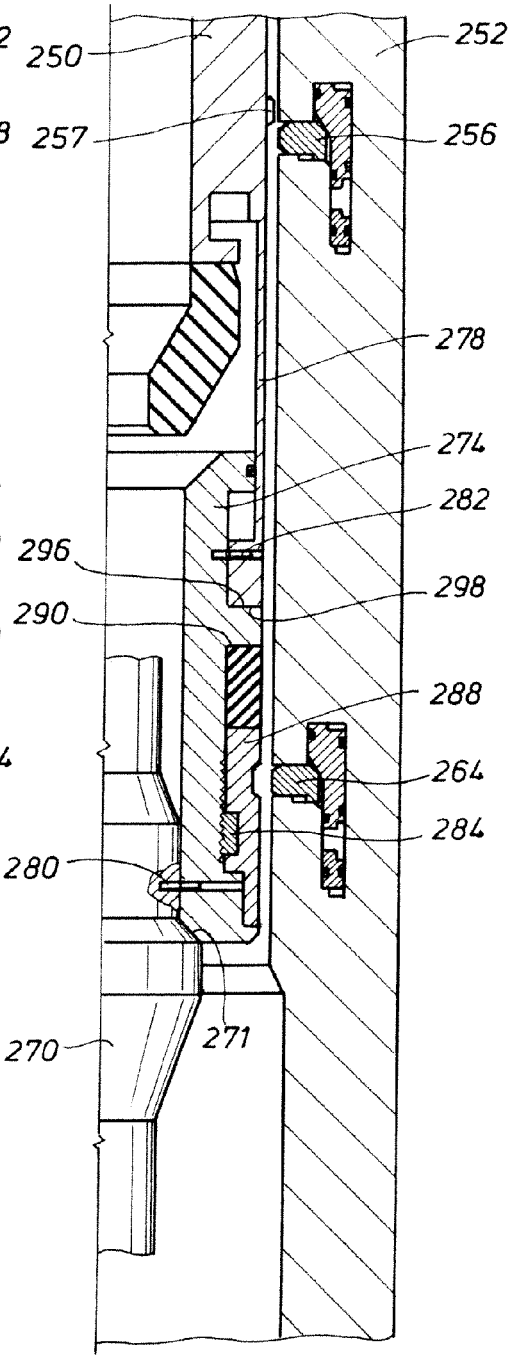
FIG. 6C is a cross-sectional elevational partial broken view of the RCD of FIG. 6B with the RCD running tool moved upward from its position in FIG. 6B, the holding member upper shear pin sheared but in its unsheared position, the ratchet shear ring sheared to allow the holding member seal to move to the unsealed position, and the riser spool or housing latching members shown in the unlatched position.

FIG. 6C shows the housing 252 in the fully released position for removal or retrieval of the RCD 250 from the housing 252. After drilling operations are completed, the running tool 270 may be moved upward through the riser toward the housing 252. When running tool shoulder 271 makes contact with tool member 274, as shown in FIG. 6C, first, second and third retainer members (256, 260, 264) should be in their latched positions, as shown in FIG. 6C. Running tool shoulder 271 then pushes tool member 274 upward, shearing the teeth of ratchet shear ring 284. As can now be understood, ratchet shear ring 284 allows ratcheting in one direction, but shears when moved in the opposite direction upon application of a sufficient force. Tool member 274 moves upward until upwardly facing blocking shoulder 296 of tool member 274 contacts downwardly facing blocking shoulder 298 of extending member 278. The pin openings used to hold the upper 282 and lower 280 shear pins should be at substantially the same elevation before the pins were sheared. FIG. 6C shows the sheared upper 282 and lower 280 shear pins being aligned. Again, the pins could be continuous in the pin opening or equidistantly spaced as desired and depending on the pin being used.

When tool member 274 moves upward, tool member blocking shoulder 290 moves upward, pulling holding member seal 290 relative to fixed retainer receiving member 288 retained by the third retainer member 264 in the latched position. The seal 290 is preferably stretched to substantially its initial shape, as shown in FIG. 6C. The retainer members (256, 260, 264) may then be moved to their first or unlatched positions as shown in FIG. 6C, and the RCD 250 and running tool 270 removed together upward from the housing 252.

Figure 7A:
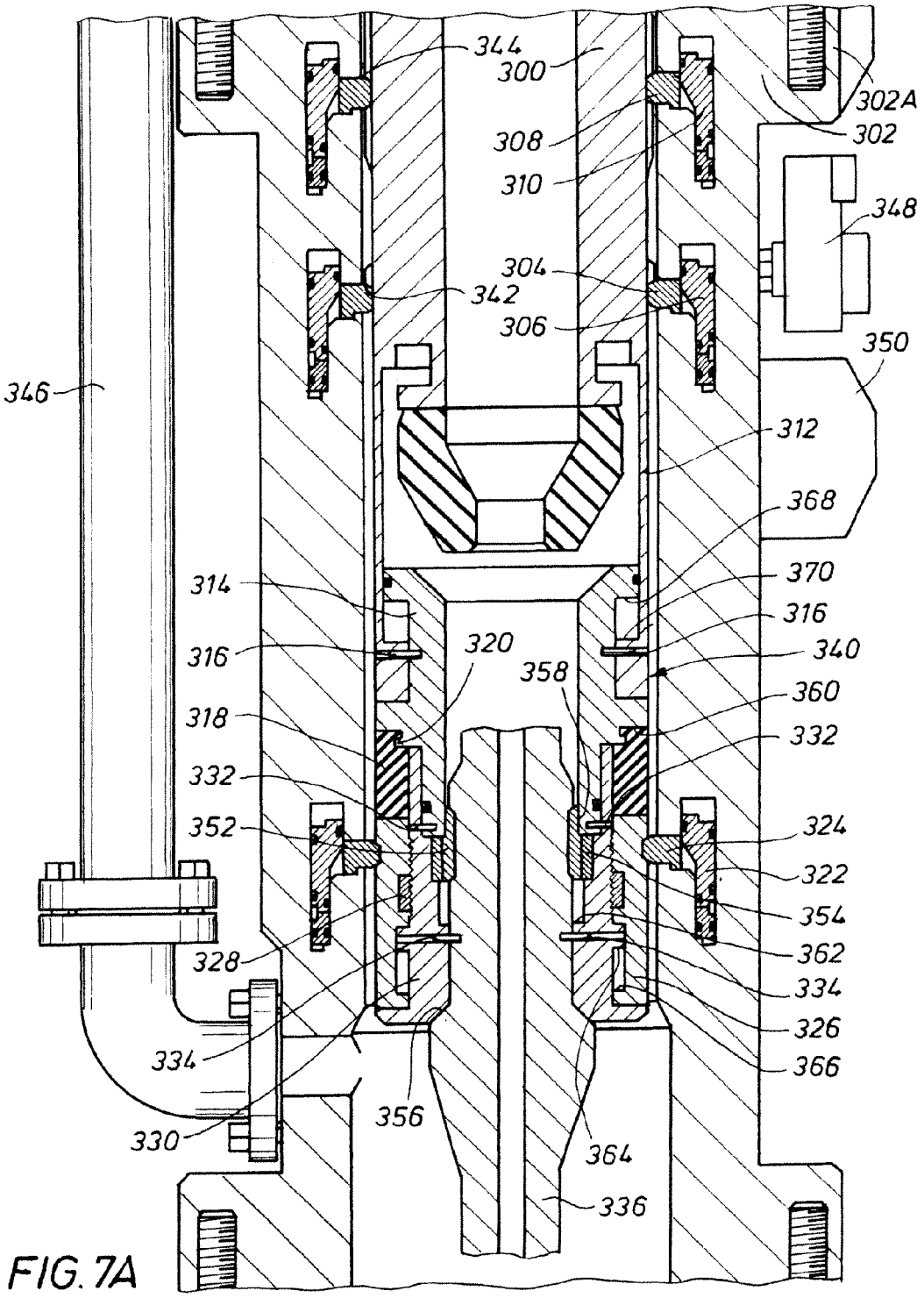
FIG. 7A is a cross-sectional elevational partial view of an RCD having a holding member with a holding member seal shown in the unsealed position, the holding member having upper, intermediate, and lower shear pins, a unidirectional ratchet or lock ring, and two concentric split C-rings.

Turning to FIG. 7A, RCD 300 and its holding member, generally designated 340, are shown latched in riser spool or housing 302 with first retainer member 304, second retainer member 308, and third retainer member or holding member retainer 324 of respective latching members (306, 310, 322) in their respective second or latched/landed positions. First retainer member 304 blocks RCD shoulder 342 and second retainer member 308 is positioned with RCD second receiving formation 344. An external bypass line 346 is positioned with housing 302. An ROV panel 348 is disposed with housing 302 between a shielding protrusion 350 and Flange 302A. Holding member 340 comprises RCD extending member 312, RCD tool member 314, tool member 330, retainer receiving member 326, holding member seal 318, upper shear pins 316, intermediate shear pins 332, lower shear pins 334, ratchet or lock ring 328, inner split C-ring 352, and outer split C-ring 354. Inner C-ring 352 has shoulder 358. Tool member 314 has downwardly facing blocking shoulders (368, 360). Tool member 330 has upwardly facing blocking shoulders 362 and downwardly facing blocking shoulder 364. Retainer receiving member 326 has downwardly facing blocking shoulder 366. Extending member 312 has downwardly facing blocking shoulder 370.

Although two upper 316, two lower 334 and two intermediate 332 shear pins are shown, it is contemplated that there may be only one upper 316, one lower 334 and one intermediate 332 shear pin or, as discussed above, that there may be a plurality of upper 316, lower 334 and intermediate 332 shear pins. Other mechanical shearing devices as are known in the art are also contemplated. Holding member seal 318 may be bonded with RCD tool member 314 and retainer receiving member 326, such as by epoxy. A lip retainer formation 320 in RCD tool member 314 fits with a corresponding formation in seal 318 to allow seal 318 to be pulled by RCD tool member 314. Although not shown, a similar lip formation may be used to connect the seal 318 with retainer receiving member 326. A combination of bonding and mechanical attachment as described above may be used.

Figure 7B:
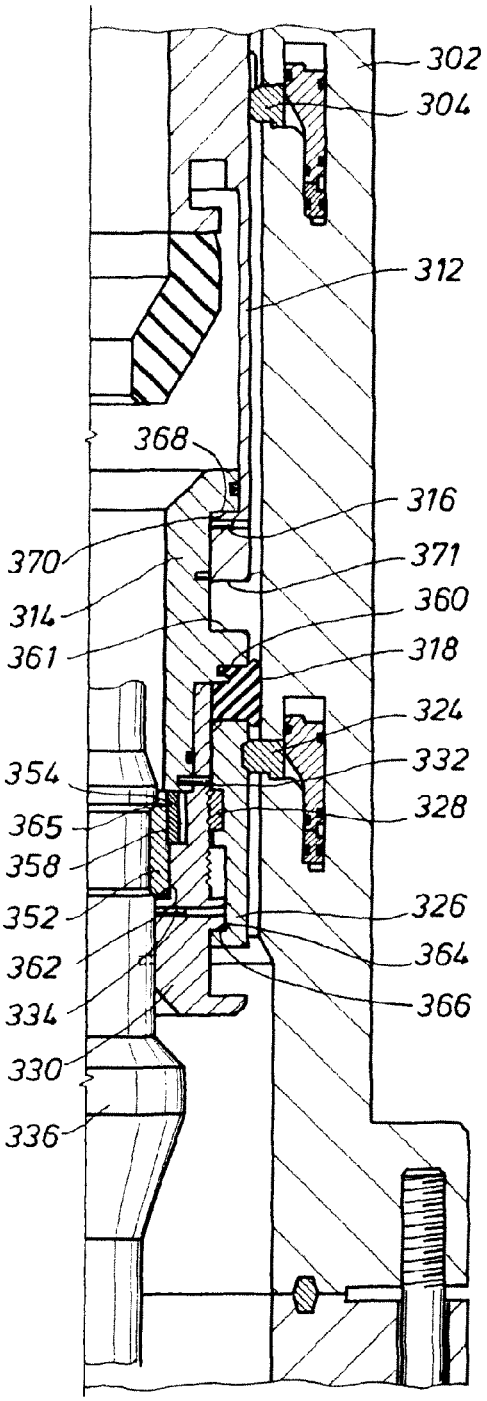
FIG. 7B is a cross-sectional elevational partial broken view of the RCD of FIG. 7A with the RCD running tool moved downward from its position in FIG. 7A, the holding member upper shear pin and lower shear pin shown sheared and the ratchet ring ratched to extrude the holding member seal to the sealed position.
Figure 7C:
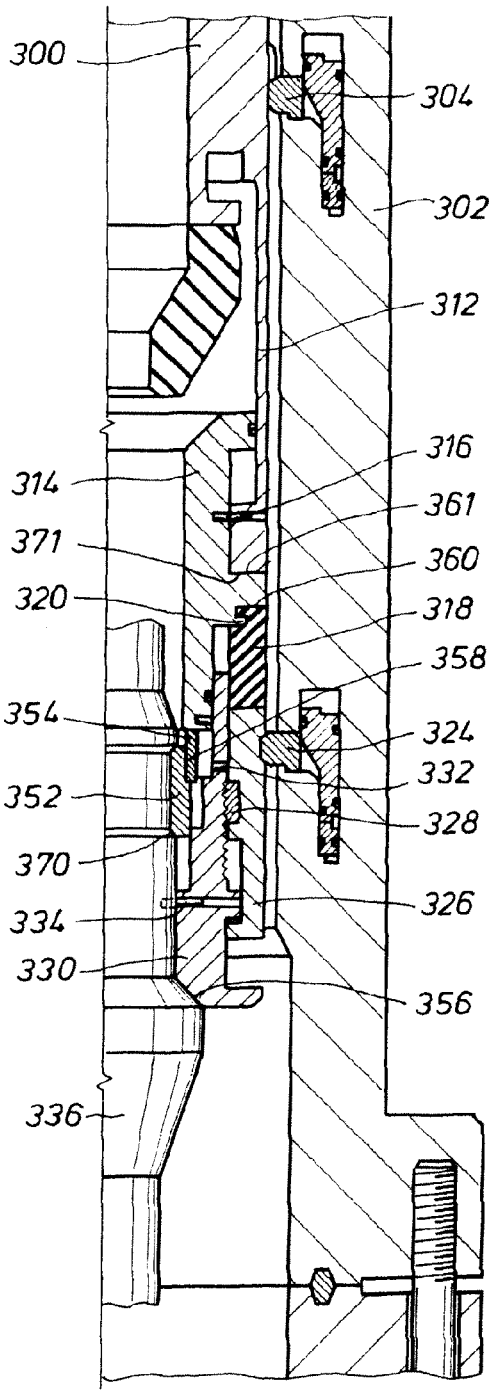
FIG. 7C is a cross-sectional elevational partial broken view of the RCD of FIG. 7B with the RCD running tool moved upward from its position in FIG. 7B, the holding member upper shear pin and lower shear pin sheared but in their unsheared positions, the intermediate shear pin sheared to allow the holding member seal to move to the unsealed position while all the riser spool or housing latching members remain in the latched position.

Holding member 340 is positioned with RCD running tool 336 with lower shear pins 334, running tool shoulder 356, and concentric C-rings (352, 354). The running tool 336 and RCD 300 are moved together from the surface through the marine riser down into housing 302 in the landing position shown in FIG. 7A. In one method, it is contemplated that before the RCD 300 is lowered into the housing 302, first retainer member 304 would be in the landed position, and second 308 and third 324 retainer members would be in their unlatched positions. RCD shoulder 342 would be blocked by first retainer member 304 to block the downward movement of the RCD 300. Second retainer member 308 would then be moved to its latched position engaging RCD receiving formation 344, which would squeeze the RCD between the first 304 and second 308 retaining members to resist rotation. Third retaining member 324 would then be moved to its latched position with retainer receiving member 326 as shown in FIGS. 7A-7C. After landing is completed, the holding member seal 318 may be set or extruded.

FIG. 7B shows the setting position used to set or extrude holding member seal 318 with housing 302. To set the extrudable seal 318, the running tool 336 is moved downward from the landing position shown in FIG. 7A so that the shoulder 365 of running tool 336 pushes the inner C-ring 352 downward. Inner C-ring 352 contacts blocking shoulder 362 of tool member 330, and pushes the tool member 330 down until the blocking shoulder 364 of the tool member 330 contacts the blocking shoulder 366 of retainer receiving member 326, as shown in FIG. 7B. Outer C-ring 354 then moves inward into groove 358 of inner C-ring 352 as shown in FIG. 7B. The downward motion of the running tool 336 first shears the lower shear pins 334, and after inner C-ring 352 urges tool member 330 downward, the upper shear pins 316 are sheared, as shown in FIG. 7B. The intermediate shear pins 332 are not sheared. As can now be understood, the intermediate shear pins 332 have a higher shear strength than the upper shear pins 316 and lower shear pins 334. The intermediate shear pin 332 pulls RCD tool member 314 downward until downwardly facing blocking shoulder 368 of RCD tool member 314 contacts upwardly facing blocking shoulder 370 of RCD extending member 312. The ratchet or lock ring 328 allows the downward ratcheting of tool member 330 relative to retainer receiving member 326. Like ratchet shear ring 284 of FIGS. 6A-6C, ratchet or lock ring 328 of FIGS. 7A-7C allows ratcheting members. However, unlike ratchet shear ring 284 of FIGS. 6A-6C, ratchet or lock ring 328 of FIGS. 7A-7C is not designed to shear when tool member 330 moves upwards, but rather ratchet or lock ring 328 resists the upward movement of the adjacent member to maintain the relative positions.

Shoulder 360 of RCD tool member 314 compresses and extrudes seal 318 against retainer receiving member 326, which is fixed by third retainer member 324. After the seal 318 is set as shown in FIG. 7B, running tool 336 may continue downward through the riser for drilling operations. Ratchet or lock ring 328 and intermediate shear pin 332 prevent tool member 330 and RCD tool member 314 from moving upwards, thereby maintaining holding member seal 318 extruded as shown in FIG. 7B during drilling operations. As can now be understood, for the embodiment shown in FIGS. 7A-7C, the running tool 336 is moved downward for setting the holding member seal 318 and pulled to release. The weight of the drill string may be relied upon for the downward force.

FIG. 7C shows the running tool 336 moved up in the housing 302 after drilling operations for unsetting the seal 318 and thereafter retrieving the RCD 300 from the housing 302. Running tool shoulder 370 makes contact with inner C-ring 352. First, second and third retainer members (304, 308, 324) are in their latched positions, as shown for first 304 and third 324 retainer members in FIG. 7C. Inner C-ring 352 shoulders with outer C-ring 354, outer C-ring 354 shoulders with RCD tool member 314 to shear intermediate shear pins 332. Ratchet or lock ring 328 maintains tool member 330. As can now be understood, ratchet or lock ring 328 allows movement of tool member 330, in one direction, but resists movement in the opposite direction. RCD tool member 314 moves upward until blocking shoulder 361 of RCD tool member 314 contacts blocking shoulder 371 of extending member 312. The openings used to hold the upper 316 and lower 334 shear pins should be at substantially the same elevation before the pins were started.

When RCD tool member 314 moves upward, RCD tool member blocking shoulder 360 moves upward, pulling holding member seal 318 with lip retainer formation 320 and/or the bonded connection since retainer receiving member 326 is fixed by the third retainer member 324 in the latched position. The retainer members (304, 308, 324) may then be moved to their first or unlatched positions, and the RCD 300 and running tool 336 together pulled upwards from the housing 302.

Figure 8A:
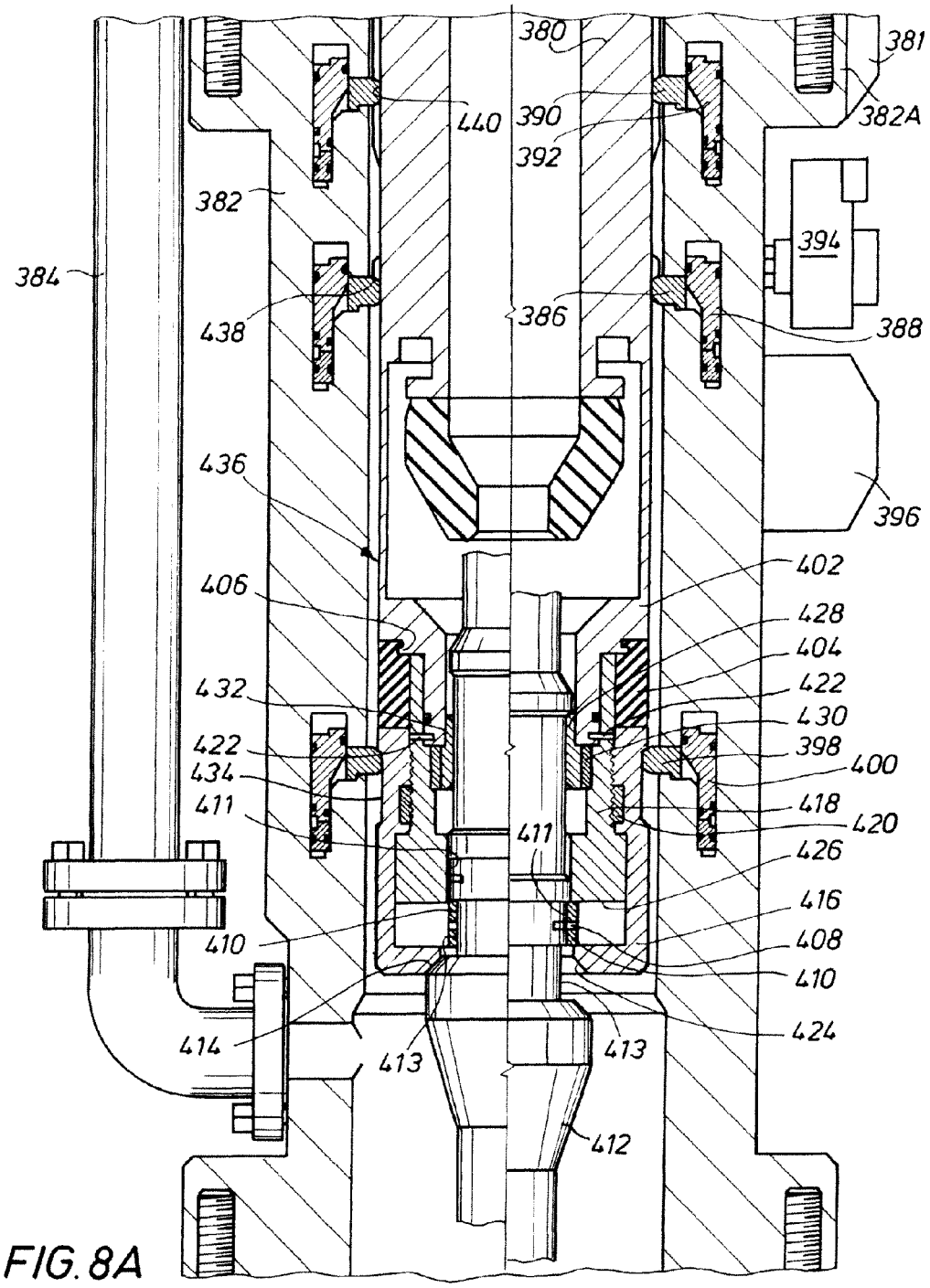
FIG. 8A is a cross-sectional elevational partial split view of an RCD having a holding member with a holding member seal shown in the unsealed position and a RCD holding member loss motion connection latched with a riser spool or housing, on the right side of the break line an upper shear pin and a lower shear pin disposed with an RCD running tool both unsheared, and on the left side of the break line, the RCD running tool moved upward from its position on the right side of the break line to shear the lower shear pin.

Turning to FIG. 8A, RCD 380 and its holding member, generally indicated 436, are shown latched in riser spool or housing 382 with first retainer member 386, second retainer member 390, and third retainer member or holding member retainer 398 of respective latching members (388, 392, 400) in their respective second or latched positions. First retainer member 386 blocks RCD shoulder 438 and second retainer member 390 is positioned with RCD receiving formation 440. An external bypass line 384 is positioned with housing 382. A valve may be positioned with line 384 and any additional bypass line. An ROV panel 394 is disposed with housing 382 between a shielding protrusion 396 and flange 382A. Holding member 436 comprises RCD extending member 402, tool member 418, retainer receiving member 416, holding member seal 404, upper shear pins 422, lower shear pins 408, ratchet lock ring 420, lower shear pin retainer ring or third C-ring 410, inner or first C-ring 428, and outer or second C-ring 430. Inner C-ring 428 has groove 432 for seating outer C-ring 430 when running tool 412 is moved downward from its position shown on the left side of the break line in FIG. 8A, as will be described in detail with FIG. 8C. Tool member 418 has blocking shoulder 426. Retainer receiving member 416 has blocking shoulder 424 and loss motion connection or groove 434 for a loss motion connection with third retainer member 398 in its latched position, as shown in FIG. 8A. Extending member 402 has a lip retainer formation 406 for positioning with a corresponding formation on seal 404.

Although two upper 422 and two lower 408 shear pins are shown for this embodiment, it is contemplated that there may be only one upper 422 and one lower 408 shear pin or, as discussed above, that there may be a plurality of upper 422 and lower 408 shear pins for this embodiment of the invention. Other mechanical shearing devices as are known in the art are also contemplated. Holding member seal 404 may be bonded with extending member 402 and retainer receiving member 416, such as by epoxy. A lip retainer formation 406 in RCD extending member 402 fits with a corresponding formation in seal 404 to allow seal 404 to be pulled by extending member 402. Although not shown, a similar lip formation may be used to connect the seal 404 with retainer receiving member 416. A combination of bonding and mechanical attachment as described above may be used. Other attachment methods are contemplated.

Holding member 436 is positioned with RCD running tool 412 with lower shear pins 408 and third C-ring 410, running tool shoulder 414, and concentric inner and outer C-rings (428, 430). The running tool 412 and RCD 380 are moved together from the surface through the marine riser down into housing 382 in the position landing shown on the right side of the break line in FIG. 8A. In one method, it is contemplated that before the RCD 380 is lowered into the housing 382, first retainer member 386 would be in the latched or landing position, and second 390 and third 398 retainer members would be in their unlatched positions. RCD shoulder 438 would contact first retainer member 386, which would block the downward movement of the RCD 380. Second retainer member 390 would then be moved to its latched position engaging RCD receiving formation 440 to squeeze the RCD 380 between the first retaining members 386 and second retaining members 390 to resist rotation. Third retaining member 398 would then be moved to its latched position with retainer receiving member 416, as shown in FIG. 8A.

On the left side of the break line in FIG. 8A, the running tool 412 has moved upwards, shearing the lower shear pins 408. Shoulder 426 of tool member 418 pushes lower shear pin retainer C-ring 410 downward to slot 413 of running tool 412. C-ring 410 has an inward bias and contracted inward from its position shown on the right side of the break line due to the diameter of the running tool 413. Blocking shoulder 414 of running tool 412 has made contact with blocking shoulder 424 of retainer receiving member 416.

Figure 8B:
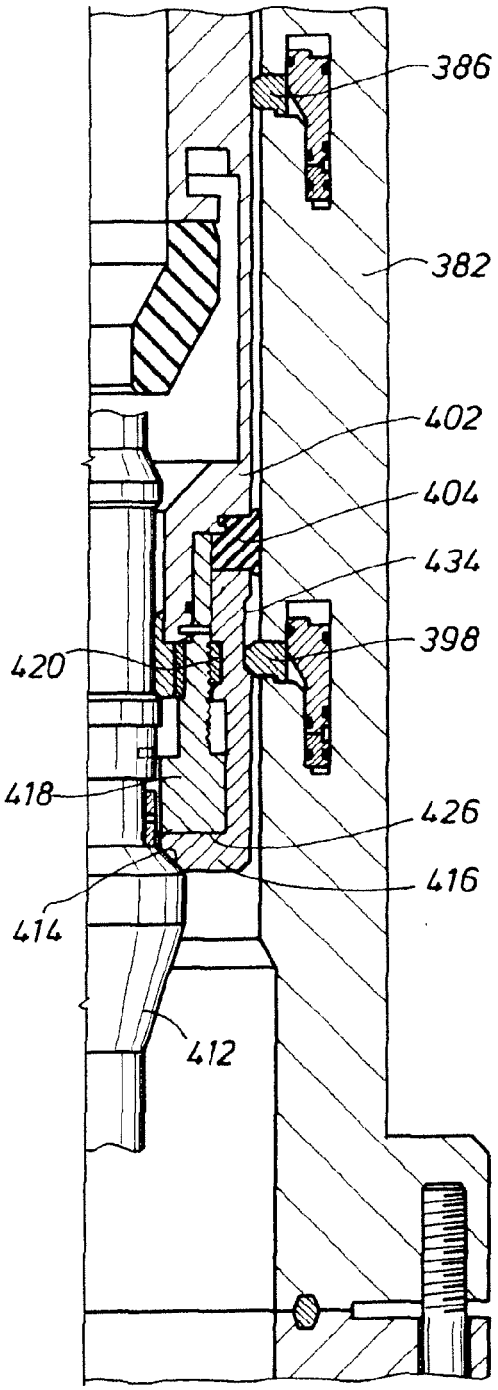
FIG. 8B is a cross-sectional elevational partial broken view of the RCD of FIG. 8A with the RCD running tool moved upward from its position on the left side of the break line in FIG. 8A, the lower latch member retainer moved to the lower end of the loss motion connection and the unidirectional ratchet ring ratcheted upwardly to extrude the holding member seal.
Figure 8C:
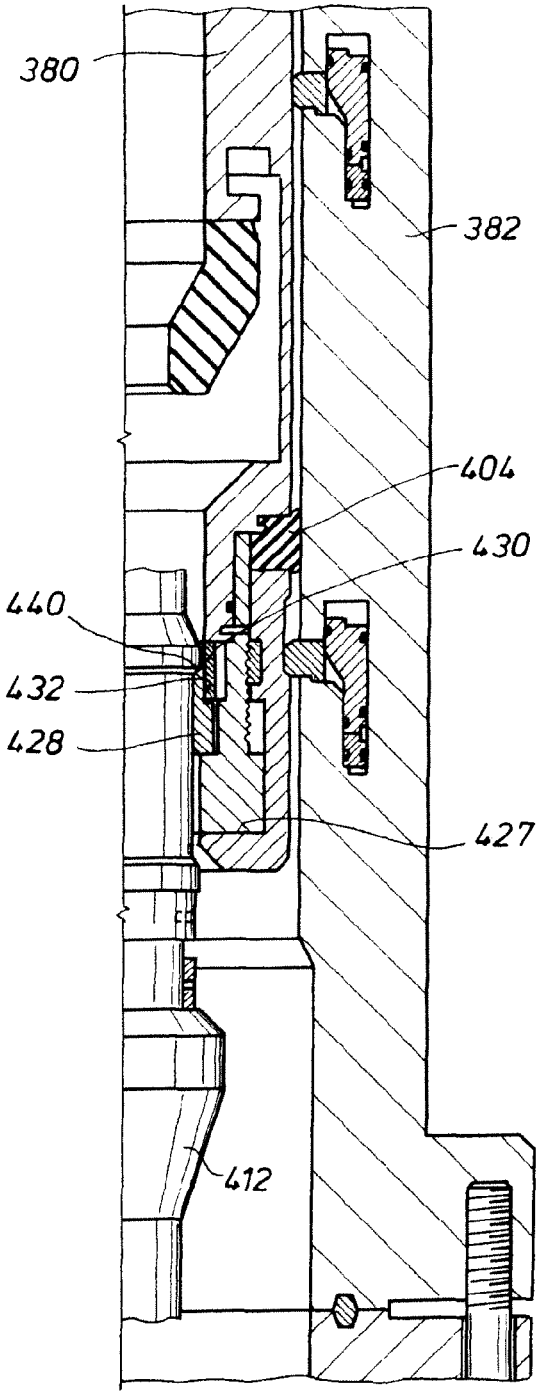
FIG. 8C is a cross-sectional elevational partial broken view of the RCD of FIG. 8B with the RCD running tool moved downward from its position in FIG. 8B, the holding member seal in the sealed position and the radially outward split C-ring moved from its concentric position to its shouldered position.

FIG. 8B shows the setting position to mechanically set or extrude holding member seal 404 with housing 382. To set the extrudable seal 404, the running tool 412 is moved upward from the landing position, shown on the right side of FIG. 8A, to the position shown on the left side of FIG. 8A. The blocking shoulder 414 of running tool 412 pushes the retainer receiving member 416 upward. Loss motion groove 434 of retainer receiving member 416 allows retainer receiving member 416 to move upward until it is blocked by downwardly facing blocking shoulder 426 of tool member 418 and the upward facing shoulder 427 of retainer receiving member 46 as shown in FIG. 8C. The ratchet or lock ring 420 allows upward ratcheting of retainer receiving member 416 with tool member 418. It should be understood that the tool member 418 does not move downwards to set the seal 404 in FIG. 8C. Like the ratchet or lock ring 328 of FIGS. 7A-7C, ratchet or lock ring 420 maintains the positions of its respective members.

Retainer receiving member 416 compresses and extrudes seal 404 against RCD extending member 402, which is latched with held by first retainer member 386. After the seal 404 is set as shown in FIG. 8B, running tool 412 may begin moving downward as shown in FIG. 8C through the riser for drilling operations. Ratchet or lock ring 420 maintains retainer receiving member 416 from moving downwards, thereby keeping holding member seal 404 extruded as shown in FIG. 8B during drilling operations. As can now be understood, for the embodiment shown in FIGS. 8A-8E, unlike the embodiments shown in FIGS. 6A-6C and 7A-7C, the running tool 412 is moved upwards for extruding the holding member seal 404.

In FIG. 8C, the running tool 412 has begun moving down through the housing 382 from its position in FIG. 8B to begin drilling operations after seal 404 has been extruded. RCD 380 remains latched with housing 382. Running tool shoulder 440 makes contact with inner C-ring 428 pushing it downwards. Outer C-ring 430, which has a radially inward bias, moves from its concentric position inward into groove 432 in inner C-ring 428, and inner C-ring 428 moves outward enough to allow running tool shoulder 440 to move downward past inner C-ring 428. Running tool may then move downward with the drill string for drilling operations.

Figure 8D:
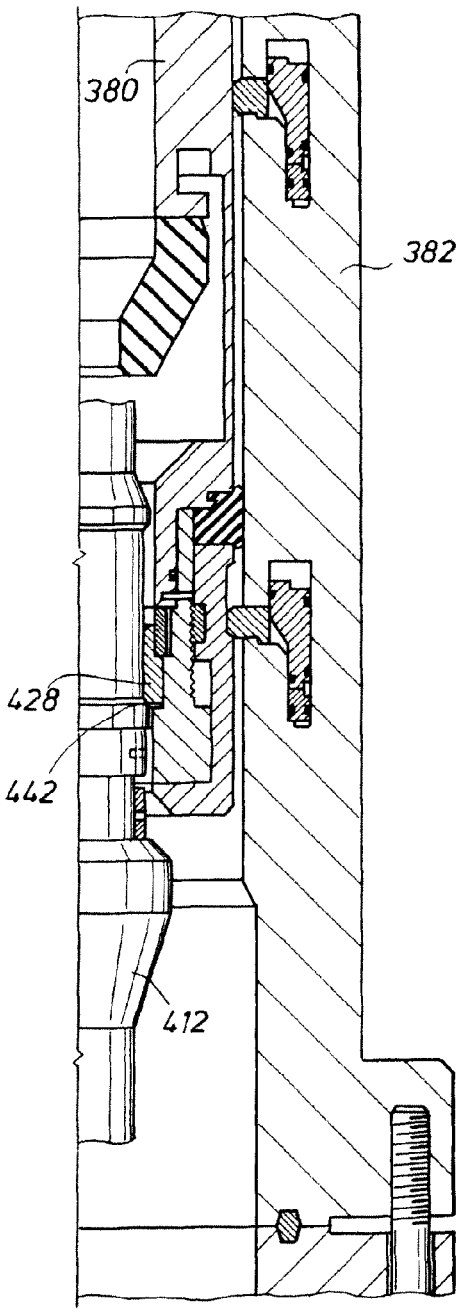
FIG. 8D is a cross-sectional elevational partial broken view of the RCD of FIG. 8C with the RCD running tool moved upward from its position in FIG. 8C so that a running tool shoulder engages the racially inward split C-ring.
Figure 8E:
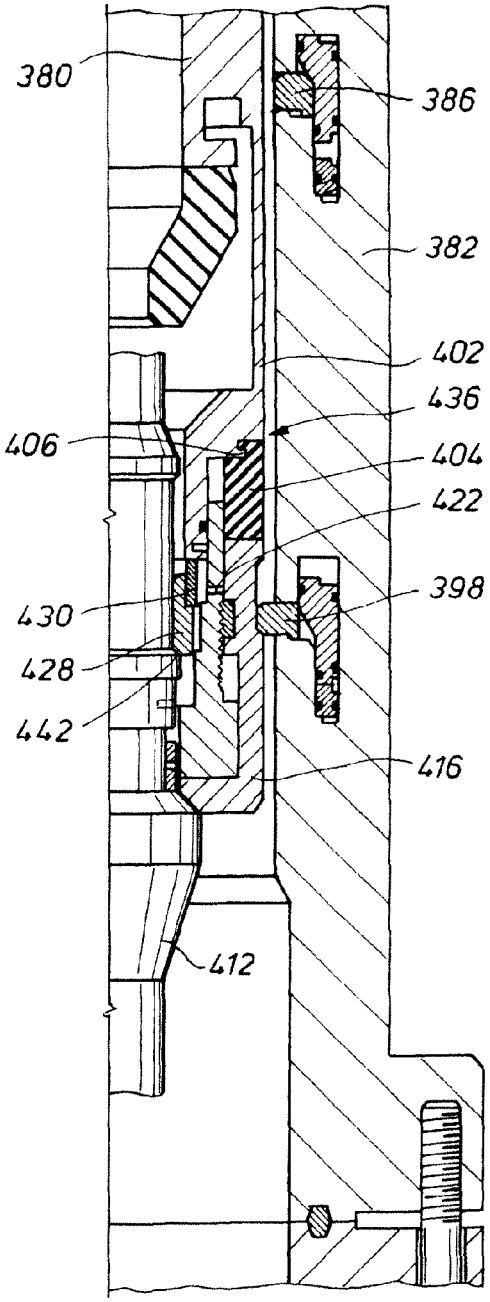
FIG. 8E is a cross-sectional elevational partial broken view of the RCD of FIG. 8D with the RCD running tool moved further upward from its position in FIG. 8D so that the shouldered C-rings shear the upper shear pin to allow the holding member seal to move to the unsealed position after the two upper latch members are unlatched.

FIG. 8D shows RCD running tool 412 returning from drilling operations and moving upwards into housing 382 for the RCD 380 retrieval process. Shoulder 442 of running tool 412 shoulders inner C-ring 428, as shown in FIG. 8D. FIG. 8E shows the holding member 436 and housing 382 in the RCD retrieval position. The first retainer members 386 and second retainer members 390 are in their first or unlatched positions. Running tool 412 moves upwards and running tool shoulder 442 shoulders inner C-ring 428 upwards, which shoulders outer C-ring 430. Outer C-ring 430 then shoulders unlatched RCD extending member 402 upwards. RCD 380 having RCD extending member 402 may move upwards since first 386 and second 390 retainer members are unlatched. Lip formation 406 of extending member 402 pulls seal 404 upwards. Seal 404 may also be bonded with extending member 402. Retainer receiving member 416 remains shouldered against third retainer 398 in the latched position. It is contemplated that seal 404 may also be bonded with retainer receiving member 416, and/or may also have a lip formation connection similar to formation 406 on extending member 402. In all embodiments of the invention, when retrieving or releasing an RCD from the housing, the running tool is pulled or moves upwards into the housing.

Figure 9A:
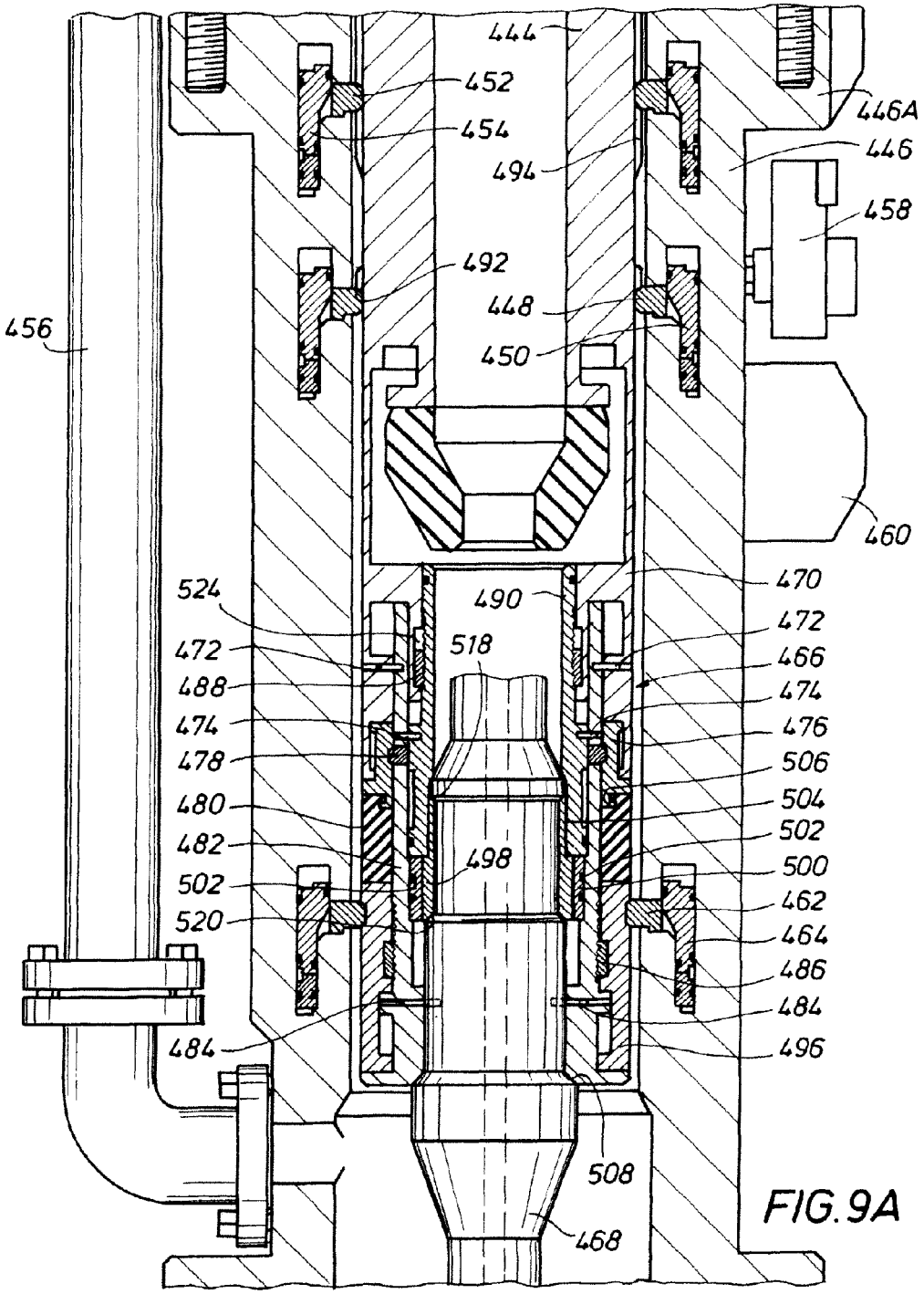
FIG. 9A is a cross-sectional elevational partial view of an RCD having a holding member with a holding member seal shown in the unsealed position, a holding member latching member in the latched position, upper, intermediate and lower shear pins, all unsheared, and an upper and a lower unidirectional ratchet or lock rings, the RCD holding member disposed with an RCD running tool, and latched with a riser spool having three latching members shown in the latched position and a bypass conduit or line.

Turning to FIG. 9A, RCD 444 and its holding member 466 are shown latched in riser spool or housing 446 with first retainer member 448, second retainer member 452, and third retainer member or holding member retainer member 462 of respective latching members (450, 454, 464) in their respective second or latched positions. First retainer member 448 blocks RCD shoulder 492 and second retainer member 452 is positioned with RCD receiving formation 494. An external bypass line 456 is positioned with housing 446. An ROV panel 458 is disposed with housing 446 between a shouldering protrusion 460 and flange 446A. Holding member 466 comprises RCD or extending member 470, RCD tool member 490, tool member 482, retainer receiving member 496, seal member 476, holding member seal 480, upper shear pins 472, intermediate shear pins 474, lower shear pins 484, holding member dog 478, upper lock ring ratchet or lock ring 488, lower ratchet or lock ring 486, inner or first C-ring 498, and outer segments 500 with two garter springs 502. It is contemplated that there may be a plurality of segments 500 held together radially around inner C-ring 498 by garter springs 502. Segments 500 with garter springs 502 are a radially enlargeable member urged to be contracted radially inward. It is also contemplated that there may be only one garter spring 502 or a plurality of garter springs 502. It is also contemplated that an outer C-ring may be used instead of outer segments 500 with garter springs 502. An outer C-ring may also be used with garter springs. Inner C-ring 498 is disposed between running tool shoulders (518, 520). Inner C-ring 498 has groove 504 for seating outer segments 500 when running tool 468 is moved downward from its position in FIG. 9A, as will be described in detail with FIG. 9C.

Upper ratchet or lock ring 488 is disposed in groove 524 of RCD extending member 470. Although two upper 472, two lower 484 and two intermediate 474 shear pins are shown for this embodiment, it is contemplated that there may be only one upper shear pin 472, one lower shear pin 484 and one intermediate sheer pin 474 shear pin or, as discussed above, that there may be a plurality of upper 472, lower 484 and intermediate 474 shear pins. Other mechanical shearing devices as are known in the art are also contemplated. Holding member seal 480 may be bonded with seal member 476 and retainer receiving member 496, such as by epoxy. A lip retainer formation 506 in seal member 476 fits with a corresponding formation in seal 480 to allow seal 480 to be pulled by seal member 476, as will be described below in detail with FIG. 9E. Although not shown, a similar lip formation may be used to connect the seal 480 with retainer receiving member 496. A combination of bonding and mechanical attachment, as described above, may be used. Other attachment methods are contemplated.

Holding member, generally indicated as 466, is positioned with RCD running tool 468 with lower shear pins 484, running tool shoulder 508, inner C-ring 498, and segments 500 with garter springs 502. The running tool 468 and RCD 444 are moved together from the surface through the marine riser down into housing 446 in the landing position shown in FIG. 9A. In one method, it is contemplated that before the RCD 444 is lowered into the housing 446, first retainer member 448 would be in the landing position, and second 452 and third 462 retainer members would be in their unlatched positions. RCD shoulder 492 would contact first retainer member 448 to block the downward movement of the RCD 444. Second retainer member 452 would then be moved to its latched position engaging RCD receiving formation 494, which would squeeze the RCD between the first 448 and second 452 retaining members to resist rotation. Third retaining member 462 would then be moved to its latched position with retainer receiving member 496 as shown in FIG. 9A.

Figure 9B:
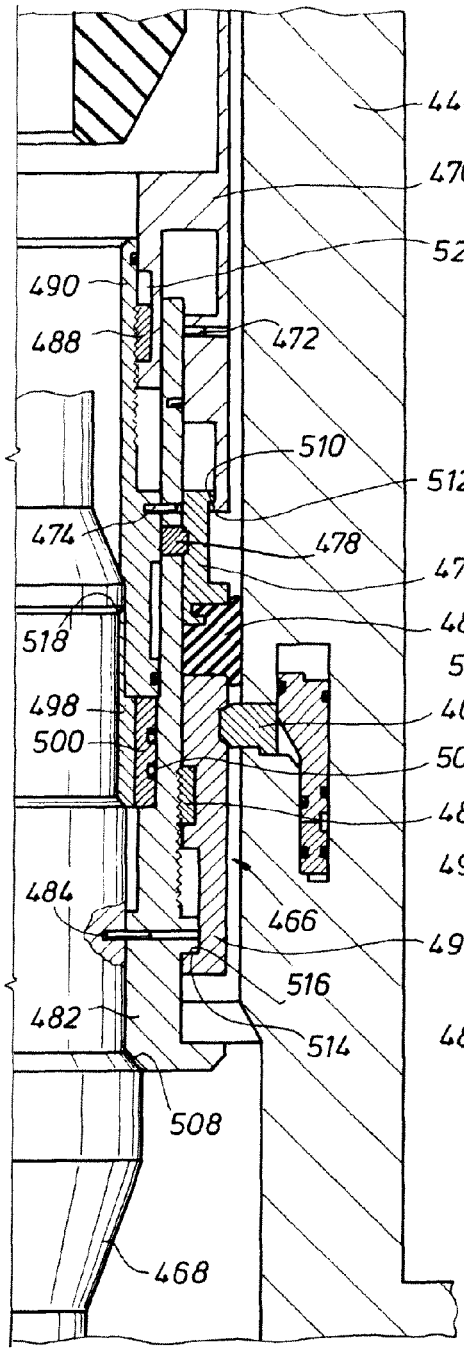
FIG. 9B is a cross-sectional elevational partial broken view of the RCD of FIG. 9A with the RCD running tool moved downward from its position in FIG. 9A, the upper shear pin sheared and the lower ratchet ring ratcheted to extrude the holding member seal.

FIG. 9B shows the first stage of the setting position used to mechanically set or extrude holding member seal 480 with housing 446. To set the extrudable seal 480, the running tool 468 is moved downward from the landing position shown in FIG. 9A. The lower shear pin 484 pulls tool member 482 downward with running tool 468. Tool member shoulder 518 also shoulders inner C-ring 498 downward relative to outer segments 500 held with garter springs 502. Similar to ratchet or lock ring 328 of FIGS. 7A-7C, lower ratchet or lock ring 486 allows the downward movement of tool member 482 while resisting the upward movement of the tool member 482. Similarly, upper ratchet or lock ring 488 allows the downward movement of RCD tool member 490 while resisting the upward movement of the RCD tool member 490. However, as will be discussed below with FIG. 9D, upper ratchet or lock ring 488 is positioned in slot 524 of extending member 470, allowing movement of upper ratchet or lock ring 488.

RCD tool member 490 is pulled downward by intermediate shear pins 474 disposed with tool member 482. The downward movement of tool member 482 shears upper shear pins 472. As can now be understood, the shear strength of upper shear pins 472 is lower than the shear strengths of intermediate shear pins 474 and lower shear pins 484 shear pins. Tool member 482 moves downward until its downwardly facing blocking shoulder 514 contacts retainer receiving member upwardly facing blocking shoulder 516. Holding member retaining dog 478 pulls seal member 476 downward until its downwardly facing shoulder 510 contacts extending member upwardly facing shoulder 512. Dog 478 may be a C-ring with radially inward bias. Other devices are contemplated. Holding member retainer 462 is latched, fixing retainer receiving member 496. Holding member seal 480 is extruded or set as shown in FIG. 9B. Lower ratchet or lock ring 486 resists tool member 482 from moving upwards, and dog 478 resists seal member 476 from moving upwards, thereby maintaining holding member seal 480 extruded as shown in FIG. 9B during drilling operations.

Figure 9C:
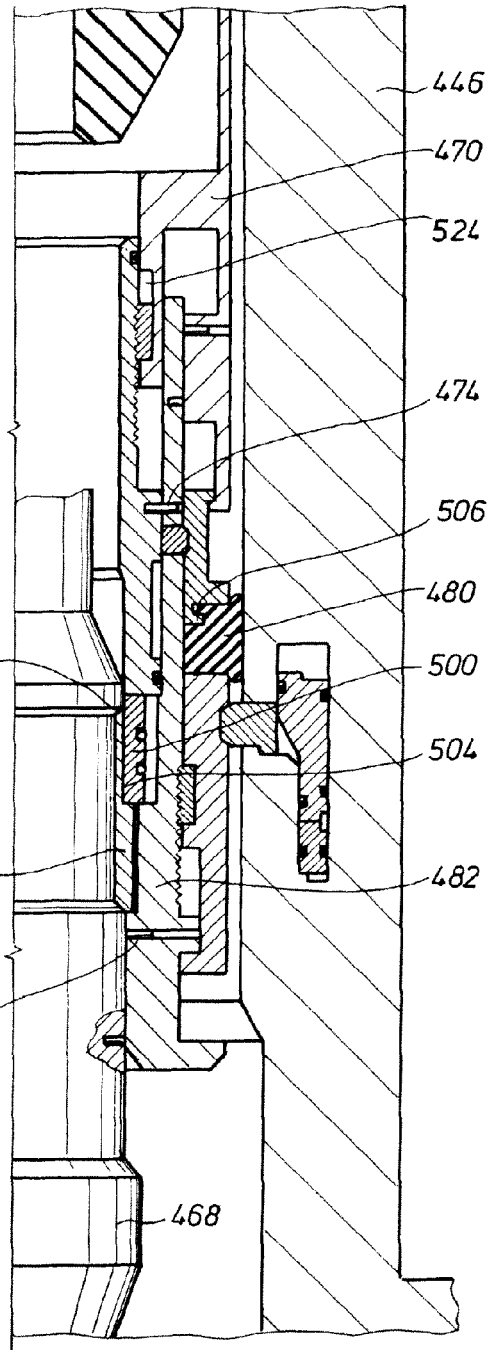
FIG. 9C is a cross-sectional elevational partial broken view of the RCD of FIG. 9B with the RCD running tool moved downward from its position in FIG. 9B, the lower shear pin sheared, and the holding member seal to the sealed position and the radially outward garter springed segments moved from their concentric position to their shouldered position.

FIG. 9C shows the final stage of setting the seal 480. Running tool 468 is moved downward from its position in FIG. 9B using the weight of the drill string to shear lower shear pin 484. As can now be understood, lower shear pin 484 has a lower shear strength than intermediate shear pin 474. RCD running tool shoulder 518 pushes inner C-ring 498 downward and outer segments 500 may move inward into groove 504 of inner C-ring 498, as shown in FIG. 9C. Running tool 468 may then proceed downward with the drill string for drilling operations, leaving RCD 444 sealed with the housing 446. As can now be understood, for the embodiment shown in FIGS. 9A-9E, the running tool 468 is moved downward for setting the holding member seal 480. The weight of the drill string may be relied upon for the downward force.

Figure 9D:
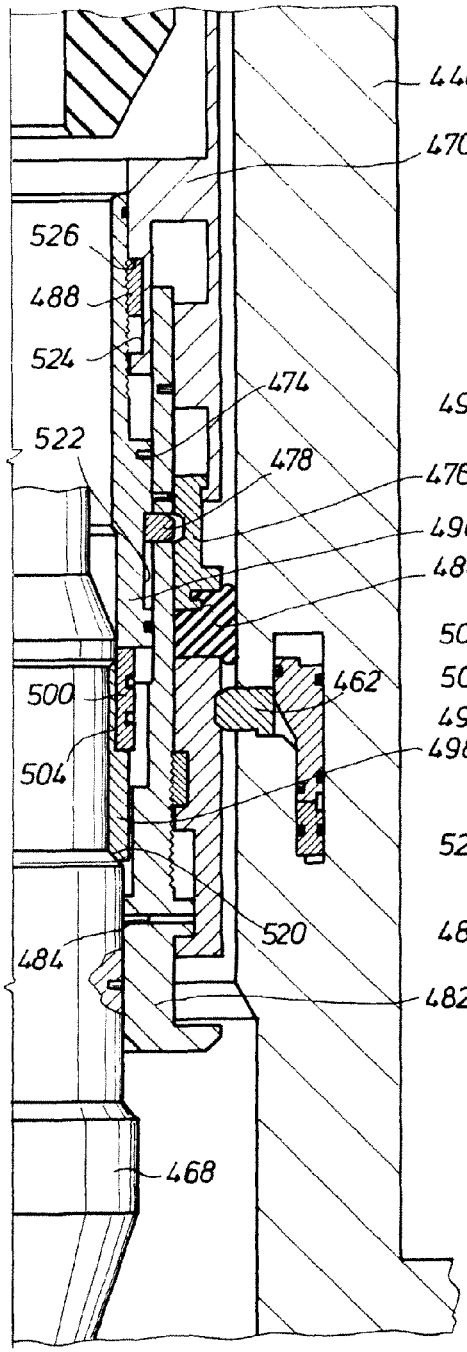
FIG. 9D is a cross-sectional elevational partial broken view of the RCD of FIG. 9C with the RCD running tool moved upward from its position in FIG. 9C so that the shouldered garter spring segments shear the intermediate shear pin to allow the holding member dog to move to the unlatched position after the two upper latch members are unlatched.

FIG. 9D shows the running tool 468 moving up in the housing 446 after drilling operations for the first stage of unsetting or releasing the seal 480 and thereafter retrieving the RCD 444 from the housing 446. Running tool shoulder 520 shoulders inner C-ring 498. Third retainer member 462 is in its latched position. Inner C-ring 498 shoulders outer segments 500 upwards by the shoulder in groove 504, and outer segments 500 shoulders RCD tool member 490 upwards, shearing intermediate shear pins 474. Upper ratchet or lock ring 488 moves upwards in slot 524 of RCD extending member 470 until it is blocked by shoulder 526 of extending member 470. Holding member retainer dog 478 is allowed to move inwardly or retracts into slot 522 of RCD tool member 490. Although not shown in FIGS. 9D-9E, first 448 retainer member and second retainer member 452, shown in FIG. 9A, are moved into their first or unlatched positions. It is also contemplated that both or either of first retainer member 448 and second retainer member 452 may be moved to their unlatched positions before the movement of the running tool 468 shown in FIG. 9D.

Figure 9E:
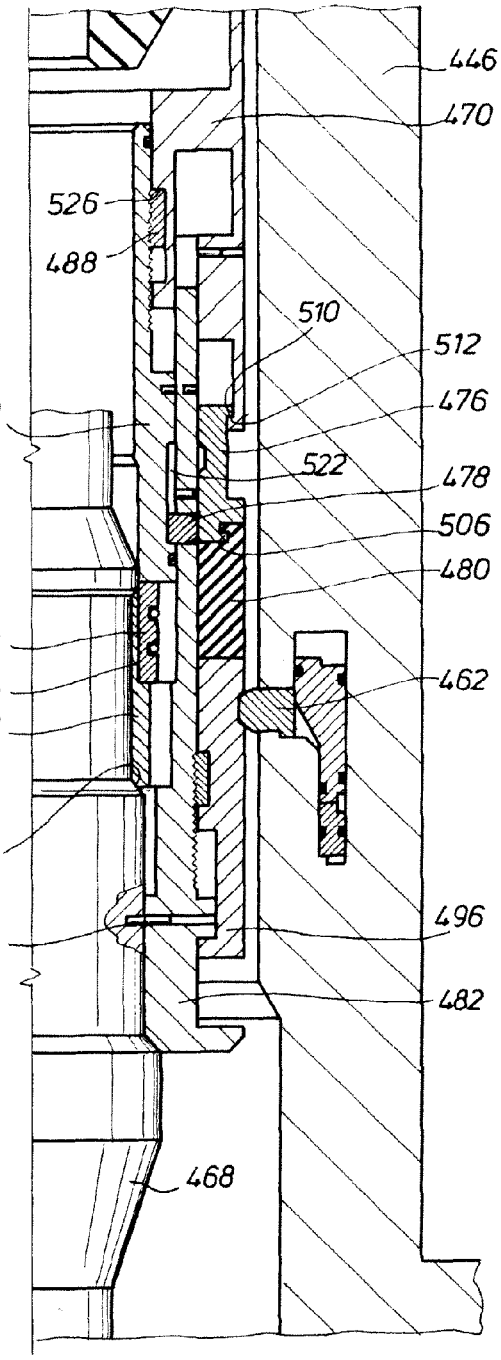
FIG. 9E is a cross-sectional elevational partial broken view of the RCD of FIG. 9D with the RCD running tool moved further upward from its position in FIG. 9D, the lower shear pin sheared but in its unsheared position, the holding member dog in the unlatched position to allow the holding member seal to move to the unsealed position after the two upper latch members are unlatched.

Turning to FIG. 9E, the final stage for unsealing seal 480 is shown. Running tool 468 is moved upwards from its position in FIG. 9D, and running tool shoulder 520 shoulders inner C-ring 498 upwards. Inner C-ring 498 shoulders outer segments 500 disposed in slot 504 of inner C-ring 498 upwards. Outer segments 500 shoulders RCD tool member 490 upwards. Since upper ratchet or lock ring 488 had previously contacted shoulder 526 of extension member 470 in FIG. 9D, upper ratchet or ring 488 now shoulders RCD extending member 470 upwards by pushing on shoulder 526. RCD extending member 470 may move upwards with RCD 444 since first retaining member 448 and second retaining member 452 are in their unlatched positions. Upwardly facing shoulder 512 of extending member 470 pulls downwardly facing shoulder 510 of seal member 476 upwards, and seal member 476, in turn, stretches seal 480 upwards through lip formation 506 and/or bonding with seal 480.

Third retainer member 462 maintains retainer receiving member 496 and the one end of seal 480 fixed, since seal 480 is bonded and/or mechanically attached with retainer receiving member 496. Holding member retainer dog 478 moves along slot 522 of RCD tool member 490. Seal 480 is preferably stretched to substantially its initial shape, as shown in FIG. 9E, at which time the openings in running tool 468 and tool member 482 for holding lower shear pins 484, which was previously sheared, are at the same elevation when the lower shear pin 484 was not sheared. Holding member retainer member or third retainer member 462 may then be moved to its first or unlatched position, allowing RCD running tool 468 to lift the RCD 444 to the surface.

Figure 10A:
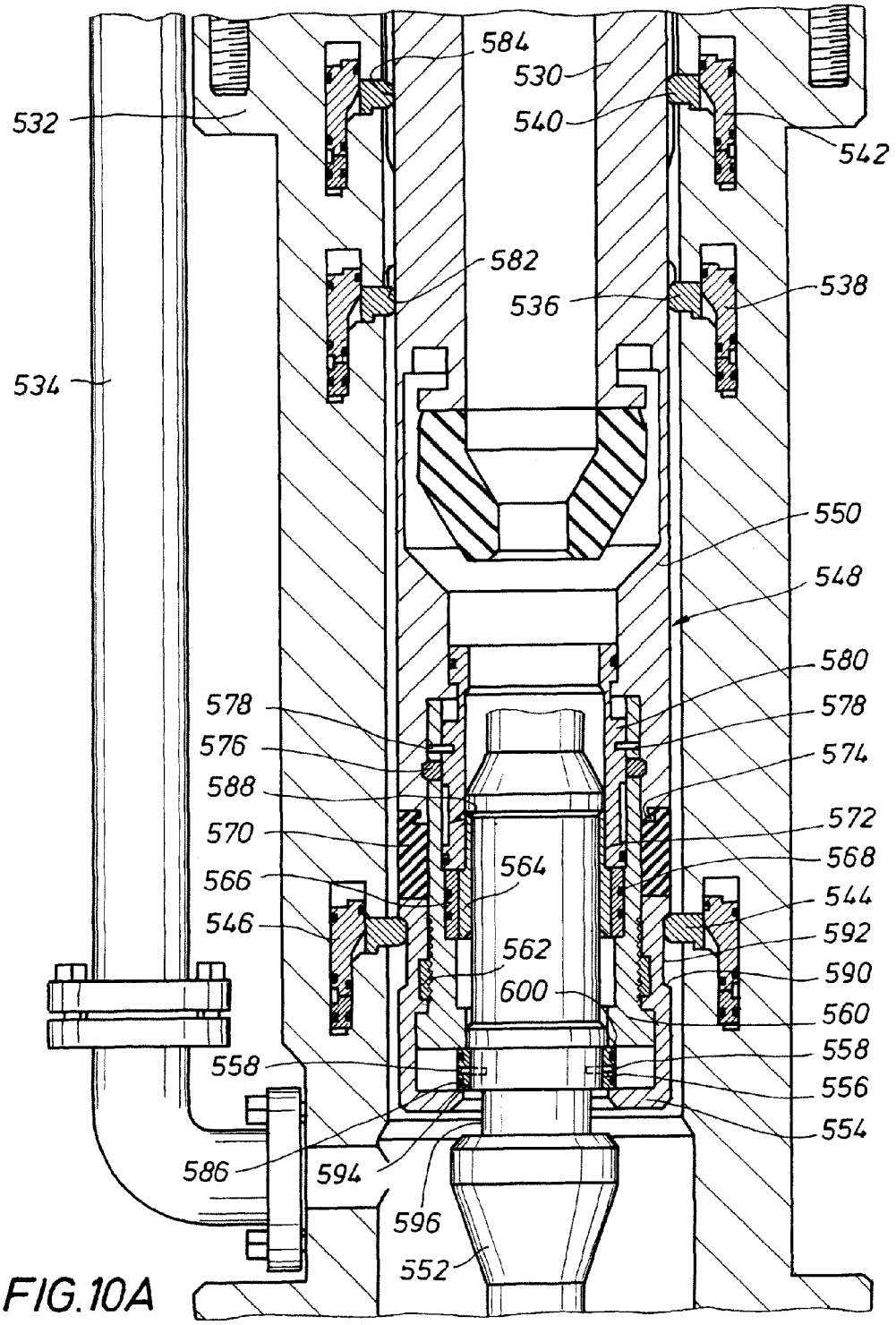
FIG. 10A is a cross-sectional elevational partial view of an RCD having a holding member, similar to FIG. 4B, with the holding member seal shown in the unsealed position, a holding member dog shown in the latched position, unsheared upper and lower shear pins, and a unidirectional ratchet or lock ring, the lower shear pin disposed between an RCD running tool and garter springed segments, and a riser spool having three latching members shown in the latched position and a bypass conduit or line.

Turning to FIG. 10A, RCD 530 and its holding member 548 are shown latched in riser spool or housing 532 with first retainer member 536, second retainer member 540, and third retainer member 544 of respective latching members (538, 542, 546) in their respective second or latched positions. First retainer member 536 blocks RCD shoulder 582 and second retainer member 540 is positioned with RCD receiving formation 584. An external bypass line 534 is positioned with housing 532. Holding member, generally indicated at 548, comprises RCD extending member 550, RCD tool member 580, tool member 560, retainer receiving member 554, holding member seal 570, upper shear pins 578, lower shear pins 558, lower shear pin holding segments 556 with garter springs 586, ratchet or lock ring 562, inner C-ring 564, outer segments 566 with garter springs 568, and holding member retaining dog 576. It is contemplated that C-rings may be used instead of segments (566, 556) with respective garter springs (568, 586), or that C-rings may be used with garter springs. Tool member shoulder 600 shoulders with lower shear pin segments 556. Inner C-ring 564 has groove 572 for seating outer segments 566 when running tool 552 is moved as described with and shown in FIG. 10C. Inner C-ring 562 shoulders with running tool shoulder 588. Retainer receiving member 554 has a blocking shoulder 590 in the loss motion connection or groove 592 for a loss motion connection with third retainer member 544 in its latched position, as shown in FIG. 10A.

Although two upper shear pins 578 and two lower shear pins 558 are shown, it is contemplated that there may be only one upper shear pin 578 and one lower shear pin 558 or, as discussed above, that there may be a plurality of upper shear pins 578 and lower shear pins 558. Other mechanical shearing devices as are known in the art are also contemplated. Holding member seal 570 may be bonded with extending member 550 and retainer receiving member 554, such as by epoxy. A lip retainer formation 574 in RCD extending member 550 fits with a corresponding formation in seal 570 to allow seal 570 to be pulled by extending member 550. Although not shown, a similar lip formation may be used to connect the seal 570 with retainer receiving member 554. A combination of bonding and mechanical attachment as described above may be used. Other attachment methods are contemplated.

Figure 10B:
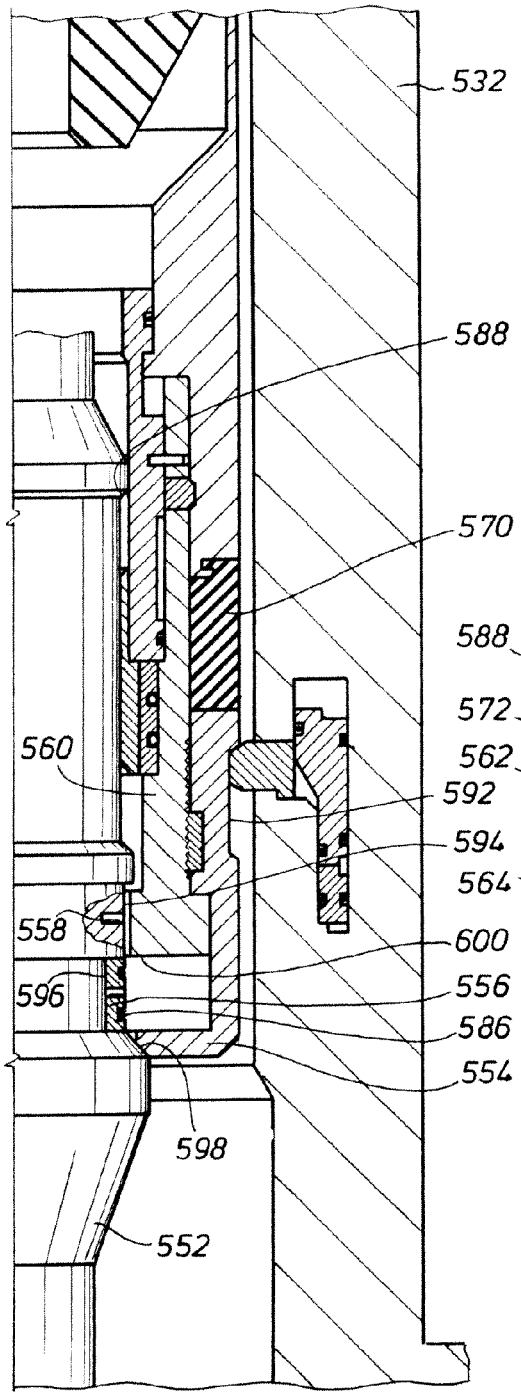
FIG. 10B is a cross-sectional elevational partial broken view of the RCD of FIG. 10A with the RCD running tool moved upward from its position in FIG. 10A, the RCD holding member loss motion connection receiving the lower latch member retainer and the lower shear pin sheared to allow the lower garter springed segments to move inwardly in a slot on the running tool.
Figure 10C:
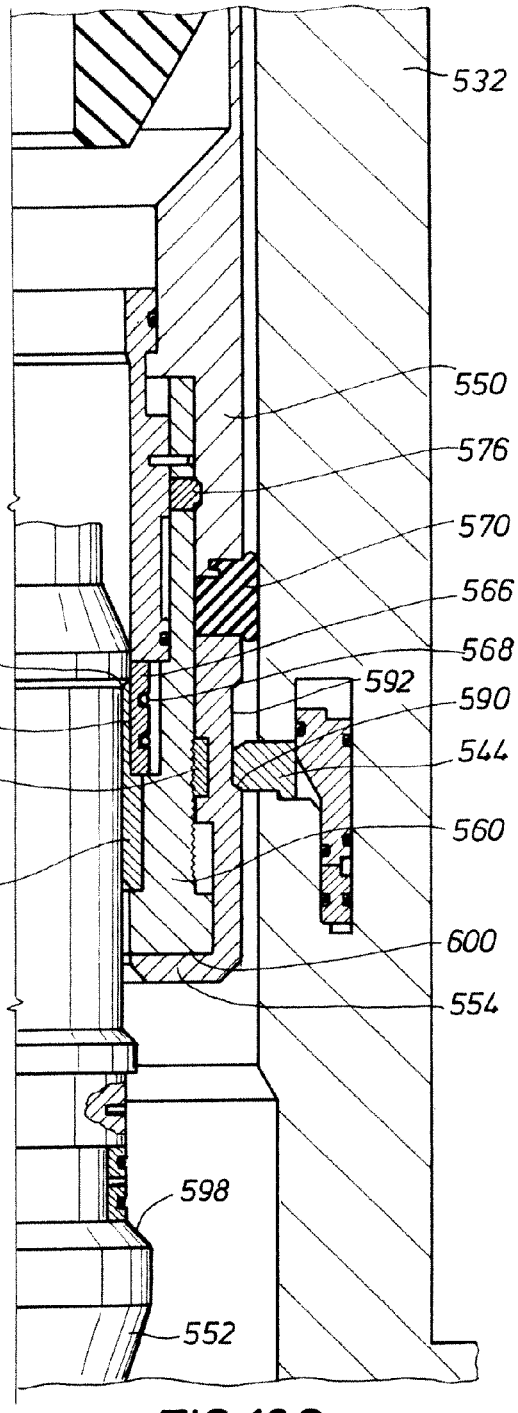
FIG. 10C is a cross-sectional elevational partial broken view of the RCD of FIG. 10B with the RCD running tool moved downward after it had moved further upward from its position in FIG. 10B to move the lower latch member retainer to the lower end of the loss motion connection and the unidirectional ratchet or lock ring maintaining the holding member seal in the sealed position and to move the upper garter springed segments from their concentric position to their shouldered position.

Holding member, generally indicated at 548, is positioned with RCD running tool 552 with lower shear pins 558 and lower shear pin segments 556, running tool shoulder 588, inner C-ring 564, and outer segments 566 with garter springs 568. Lower shear pin segments 556 are disposed on running tool surface 594, which has a larger diameter than adjacent running tool slot 596. The running tool 552 and RCD 530 are moved together from the surface through the marine riser down into housing 532 in the landing position shown in FIG. 10A. In one method, it is contemplated that before the RCD 530 is lowered into the housing 532, first retainer member 536 would be in the landing position, and second 540 and third 544 retainer members would be in their unlatched positions. RCD shoulder 582 would be blocked by first retainer member 536, which would block downward movement of the RCD 530. Second retainer member 540 would then be moved to its latched position engaging RCD receiving formation 584, which would squeeze the RCD 530 between the first 536 and second 540 retaining members to resist rotation. Third retaining member 544 would then be moved to its latched position with retainer receiving member 554 in loss motion connection or groove 592 as shown in FIG. 10A. After landing is completed, the process of extruding the holding member seal 570 may begin as shown in FIGS. 10B-10C. As indicated in the drawings of the respective holding member extrudable seal 198 (FIG. 4A), seal 276 (FIGS 6A and 6B), seal 318 (FIGS. 7A, 7B and 7C), seal 404 (FIGS. 8A, 8B, 8C and 8E), seal 480 (FIGS. 9A, 9B, 9C, 9D, and 9E) and seal 570 (FIGS. 10A, 10B, 10C, 10D and 10E) the holding member ectrudable seals are fabricated from rubber.

To continue setting or extruding seal 570, the running tool 552 is further moved upwards from its position shown in FIG. 10B. The seal 570 final setting position is shown in FIG. 10C, but in FIG. 10C the running tool 552 has already been further moved upwards from its position in FIG. 10B, and then is shown moving downwards in FIG. 10C with the drill string for drilling operations. To set the seal 570 as shown in FIG. 10C, the running tool 552 moves up from its position in FIG. 10B, and running tool shoulder 598 shoulders retainer receiving member 554 upwards until blocked by shoulder 600 of tool member 560. The ratchet or lock ring 562 allows the unidirectional upward movement of retainer receiving member 554 relative to tool member 560. Like the ratchet or lock ring 328 of FIGS. 7A-7C, ratchet or lock ring 562 resists the upward movement of the tool member 560.

Loss motion connection or groove 592 of retainer receiving member 554 allows retainer receiving member 554 to move upward until it is blocked by the third retainer 544 contacting shoulder 590 at one end of slot 592, as shown in FIG. 10C. Retainer receiving member 554 mechanically compresses and extrudes seal 570 against RCD extending member 550, which, as shown in FIG. 10A, is latchingly fixed by first retainer member 536. After the seal 570 is set with the upward movement of the running tool 552 from its position shown in FIG. 10B, inner C-ring 564 and outer segments 566 will still be concentrically disposed as shown in FIG. 10B. Running tool 552 may then be moved downward with the drill string for drilling operations. With this downward movement, running tool shoulder 588 shoulders inner C-ring 564 downwards, and outer segments 566 with their garter springs 568 will move inward into groove 572 in inner C-ring 564 in the position shown in FIG. 10C. The running tool 552 then, as described above, continues moving down out of the housing 530 for drilling operations. Ratchet or lock ring 562 resists retainer receiving member 554 from moving downwards, thereby maintaining holding member seal 570 extruded, as shown in FIG. 10C during the drilling operations. As can now be understood, for the embodiment shown in FIGS. 10A-10E, like the embodiment shown in FIGS. 8A-8E, and unlike the embodiments shown in FIGS. 6A-6C, 7A-7C and 9A-9E, the running tool is moved upwards for mechanically setting or extruding the holding member seal.

Figure 10D:
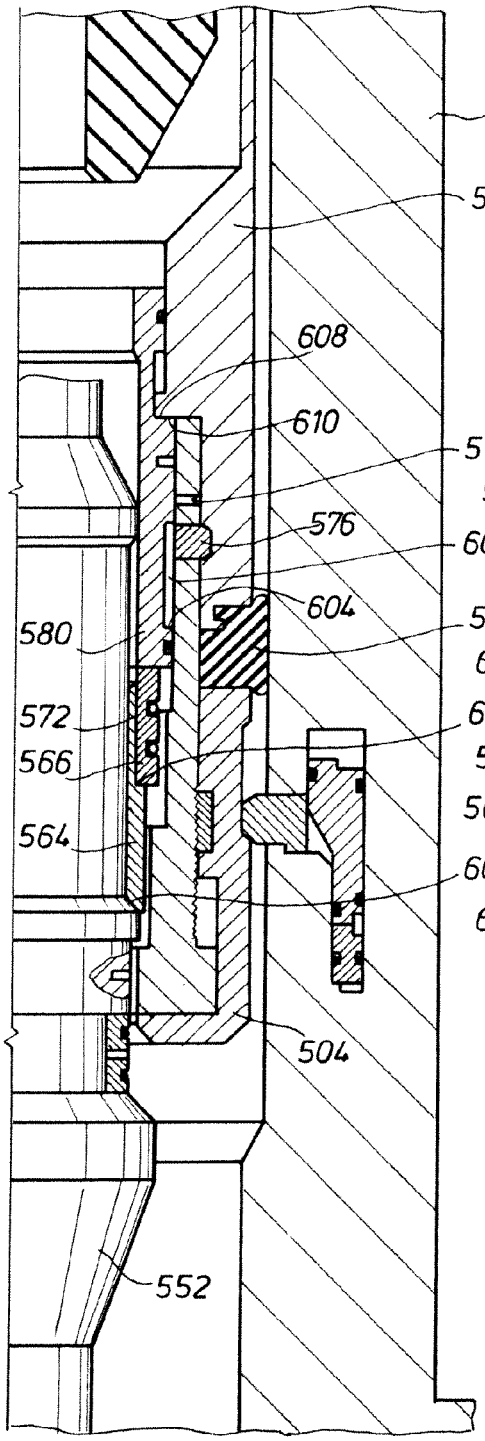
FIG. 10D is a cross-sectional elevational partial broken view of the RCD of FIG. 10C with the RCD running tool moved upward from its position in FIG. 10C after running down hole, so the shouldered garter spring segments shear the upper shear pin while the holding member seal is maintained in the sealed position after the two upper latch members are unlatched.

FIG. 10D shows RCD running tool 552 moving upwards into housing 532 returning upon drilling operations for the beginning of the RCD 530 retrieval process. When blocking shoulder 602 of running tool 552 shoulders inner C-ring 564, as shown in FIG. 10D, the first retainer members 536 and second retainer members 540 are preferably in their first or unlatched positions. It is also contemplated that the retainer members 536, 540 may be unlatched after the running tool 552 is in the position shown in FIG. 10D but before the position shown in FIG. 10E. Shoulder 612 of inner C-ring groove 572 shoulders outer segments 566 upward. Outer segments 566, in turn, shoulders RCD tool member 580 upwards. RCD tool member 580, in turn, moves upward until its upwardly facing blocking shoulder 608 is blocked by downwardly facing shoulder 610 of RCD extending member 550. The upward movement of RCD tool member 580, as shown in FIG. 10D, allows the retraction of holding member dog 576 into slot 606.

Figure 10E:
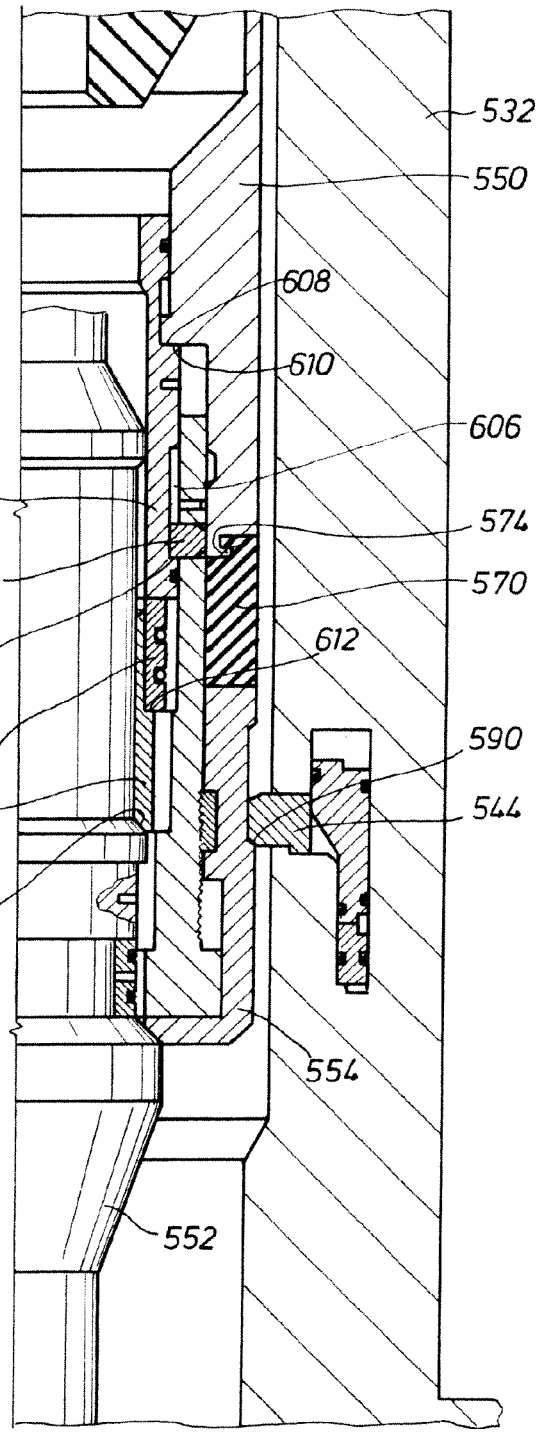
FIG. 10E is a cross-sectional elevational partial broken view of the RCD of FIG. 10D with the RCD running tool moved further upward from its position in FIG. 10D so the holding member dog can move to its unlatched position to allow the holding member seal to move to the unsealed position after the two upper latch members are unlatched.

Turning now to FIG. 10E, running tool 552 moves further upward from its position in FIG. 10D continuing to shoulder inner C-ring 564 upward with running tool shoulder 602. Outer segments 566 continue to shoulder RCD tool member 580 so holding member dog 576 moves along slot 606 until contacting shoulder 604 at the end of the RCD tool member slot 606. Dog 576 may be a C-ring or other similar device with a radially inward bias. Blocking shoulder 608 of RCD tool member 580 shoulders blocking shoulder 610 of RCD extending member 550 upwards. RCD 530 having RCD extending member 550 moves upward since first retainer members 536 and second retainer members 540 are unlatched. Lip formation 574 of extending member 550 pulls and stretches seal 570 upward. Seal 570 may also be bonded with extending member 550. Retainer receiving member 554 shouldered at shoulder 590 is blocked by third retainer 544 in the latched position. It is contemplated that retainer receiving member 554 may also have a lip formation similar to formation 574 on extending member 550 and be bonded for further restraining both ends of seal 570. After seal 570 is unset or released, third retainer member 544 may be moved to its unlatched position and the running tool 552 moved upward to the surface with the RCD 530.

The foregoing disclosure and description of the invention are illustrative and explanatory thereof, and various changes in the details of the illustrated apparatus and system, and the construction and the method of operation may be made without departing from the spirit of the invention.

We claim:

1. A seal assembly, comprising:

an annular seal;

a retainer receiving member having a formation;

a moveable tool member releasablv configured to move relative to said retainer receiving member and configured to extrude said seal between said retainer receiving member and said moveable tool member;

an extending member having a blocking shoulder and releasably connected with said moveable tool member; and a first shear device between said retainer receiving member and said moveable tool member configured to allow relative movement between said retainer receiving member and said moveable tool member.

2. The seal assembly of claim 1, further comprising:

said moveable tool member having a blocking shoulder configured to engage with said extending member blocking shoulder to block movement of said tool member relative to said extending member; and a second shear device between said extending member and said moveable tool member configured to allow relative movement between said extending member and said moveable tool member.

3. The seal assembly of claim 2, wherein said moveable tool member having a first portion releasable with said retainer receiving member and a second portion having said blocking shoulder configured to block movement relative to said extending member, wherein said moveable tool member first portion is releasably connected with said moveable tool member second portion, wherein said moveable, tool member further comprising a third portion configured for releasing said moveable tool member first portion from said moveable tool member second portion, wherein said moveable tool member third portion having a slot configured to allow said moveable tool member first portion to move relative to said moveable tool member second portion.

4. The seal assembly of claim 3, further comprising:

a first ring; and a second. ring concentrically positioned with said first ring and configured to move from a concentric portion to a shouldered position for moving said third portion, wherein said second ring is configured to move said tool member third portion to allow said seal assembly annular seal to move to an unextruded position.

5. The seal assembly of claim 1, wherein said annular seal is fabricated from rubber and is configured to be constrained by said moveable tool member and said retainer receiving member to only extrude in one direction.

6. The seal assembly of claim 1 wherein said first shear device is a ratchet ring configured to ratchet in one direction and shear in the opposite direction.

7. A seal assembly, comprising:

an annular seal:

a retainer receiving member having a loss motion connection formation;

a moveable tool member releasably configured to move relative to said retainer receiving member and configured to extrude said seal;

an extending member having a blocking shoulder and releasablv connected with said moveable tool member; and a ratchet ring disposed between said retainer receiving member and said moveable tool member and configured to ratchet in one direction relative to said retainer receiving, member and said moveable tool member.

8. The seal assembly of claim 7, further comprising:

said moveable tool member having a blocking shoulder configured to engage with said extending member blocking shoulder to block movement of said tool member relative to said extending. member; and a dog between said extending member and said moveable tool member configured to allow relative movement between said extending member and said moveable tool member.

9. The seal assembly of claim 8, wherein said moveable tool member having a first portion releasably connected with said retainer receiving member and a second portion having said blocking shoulder configured to block movement relative to said extending member.

10. The seal assembly of claim 9, wherein said moveable tool member first portion is releasably connected with said moveable tool member second portion using a shear device.

11. The seal assembly of claim 9, wherein said moveable tool member second portion is configured for releasing said moveable tool member first portion from said extending member.

12. The seal assembly of claim 8, further comprising:

a first ring; and a second ring concentrically positioned with said first ring and configured to move from a concentric position to a shouldered position for moving said extending member, wherein said second ring is configured to move said extending member to allow said seal assembly annular seal to move to an unextruded position.

13. The seal assembly of claim 9, wherein said moveable tool member second portion having a slot configured to receive said dog to allow said moveable tool member first portion to move relative to said extending member, further comprising:

a first ring: and a second ring concentrically positioned with said first ring and configured to move from a concentric position to a shouldered position for moving said tool member second portion, wherein said second ring is configured to move said tool member second portion to allow said seal assembly annular seal to move to an unextruded position.

14. The seal assembly of claim 7, wherein said annular seal is fabricated from rubber and is configured to be constrained by said moveable tool member and said retainer receiving member to only extrude in one direction.

15. A seal assembly adapted for use with a rotating control device having an inner member rotatable relative to an outer member, comprising:

an annular seal;

a retainer receiving member having a formation;

a moveable tool member releasably configured to move relative to said retainer receiving member and configured to extrude said seal between said retainer receiving member and said moveable tool member;

an extending member having a blocking shoulder configured to support the rotating control device, said extending member releasably connected with said moveable tool member; and a first shear device between said retainer receiving member and said moveable tool member configured to allow relative movement between said retainer receiving member and said moveable tool member.

16. The seal assembly of claim 15, further comprising:

said moveable tool member having a blocking shoulder configured to engage with said extending member blocking shoulder to block movement of said tool member relative to said extending member; and a second shear device between said extending member and said moveable tool member configured to allow relative movement between said extending member and said moveable tool member.

17. The seal assembly of claim 16, wherein said moveable tool member having a first portion releasable with said retainer receiving member and a second portion having said blocking shoulder configured to block movement relative to said extending ember, wherein said moveable tool member first portion is releasably connected with said moveable tool member second portion, wherein said moveable tool member further comprising a third portion configured for releasing said moveable tool member first portion from said moveable tool member second portion, wherein said moveable tool member third portion having a slot configured to allow said moveable tool member first portion to move relative to said moveable tool member second portion.

18. The seal assembly of claim 17, further comprising:

a first ring; and a second ring concentrically positioned with said first ring and configured to move from a concentric portion to a shouldered position for moving said third portion, wherein said second ring is configured to move said tool member third portion to allow said seal assembly annular seal to move to an unextruded position.

19. The seal assembly of claim 15, wherein said annular seal is fabricated from rubber and is configured to be constrained by said moveable tool member and said retainer receiving member to only extrude in one direction.

20. The seal assembly of claim 15, wherein said first shear device is a ratchet ring configured to ratchet in one direction and shear in the opposite direction.

21. A seal assembly adapted for use with a rotating control device having an inner member rotatable relative to an outer member. comprising:

an annular seal;

a retainer receiving member having a loss motion connection formation;

a moveable tool member releasably configured to move relative to said retainer receiving member and configured to extrude said seal;

an extending member having a blocking shoulder configured to support the rotating control device, said seal is configured to extrude between said extending member and said retainer receiving member; and a shear device between said retainer receiving member and said moveable tool member configured to allow relative movement between said retainer receiving member and said moveable tool member.

22. The seal assembly of claim 21, further comprising:

said moveable tool member having a blocking shoulder configured to engage with said extending member blocking shoulder to block movement of said tool member relative to said extending member; and a dog between said extending member and said moveable tool member configured to allow relative movement between said extending member and said moveable tool member.

23. The seal assembly of claim 22, wherein said moveable tool member having a first portion releasably connected with said retainer receiving member and a second portion having said blocking shoulder configured to block movement relative to said extending member.

24. The seal assembly of claim 22, further comprising:

a first ring; and a second ring concentrically positioned with said first ring and configured to move from a concentric position to a shouldered position for moving said extending member, wherein said second ring is configured to move said extending member to allow said seal assembly annular seal to move to an unextruded position.

25. The seal assembly of claim 22, wherein said moveable tool member second portion having a slot configured to receive said dog to allow said moveable tool member first portion to move relative to said extending member, further comprising:

a first ring; and a second ring concentrically positioned with said first ring and configured to move from a concentric position to a shouldered position for moving said tool member second portion, wherein said second ring is configured, to move said tool member second portion to allow said seal assembly annular seal to move to an unextruded position.

26. The seal assembly of claim 21, wherein said annular seal is fabricated from rubber and is configured to be constrained by said moveable tool member and said retainer receiving member to only extrude in one direction.

27. The seal assembly of claim 21, wherein said shear device is a ratchet ring, configured to ratchet in one direction.

* * * * *